US012760889B2

(12) United States Patent
Chmelar et al.

(10) Patent No.: US 12,760,889 B2
(45) Date of Patent: Oct. 13, 2026

(54) METHOD AND BURNER OF HYDROGEN COMBUSTION IN INDUSTRIAL FURNACE, ESPECIALLY IN A GLASS FURNACE OR A FURNACE FOR METAL MELTING, BY MEANS OF A MULTI NOZZLE BURNER

(71) Applicant: FLAMMATEC, SPOL. S R.O., Vsetin (CZ)

(72) Inventors: Josef Chmelar, Vsetin (CZ); Petr Jandácek, Vsetin (CZ); Petr Vojtech, Protivinc (CZ); Andreas Birle, Cottbus (DE); Jan Bensch, Halenkov (CZ)

(73) Assignee: FLAMMATEC, SPOL. S.R.O., Vsetin (CZ)

( * ) Notice: Subject to any disclaimer, the term of this patent is extended or adjusted under 35 U.S.C. 154(b) by 819 days.

(21) Appl. No.: 17/925,465

(22) PCT Filed: May 19, 2020

(86) PCT No.: PCT/EP2020/063960
§ 371 (c)(1),
(2) Date: Nov. 15, 2022

(87) PCT Pub. No.: WO2021/233530
PCT Pub. Date: Nov. 25, 2021

(65) Prior Publication Data
US 2023/0184427 A1 Jun. 15, 2023

(51) Int. Cl.
*F23D 14/22* (2006.01)
*F23D 14/32* (2006.01)
(Continued)

(52) U.S. Cl.
CPC ..... *F23D 14/22* (2013.01); *F23D 14/32* (2013.01); *F23D 14/583* (2013.01); *F23N 1/025* (2013.01); *F23C 2900/9901* (2013.01)

(58) Field of Classification Search
CPC ..... F23D 14/583; F23D 14/32; F23D 14/22; F23N 1/025
(Continued)

(56) References Cited

U.S. PATENT DOCUMENTS 5,299,929 A 4/1994 Yap
6,190,158 B1 2/2001 Legiret et al.
(Continued)

FOREIGN PATENT DOCUMENTS

DE 10 2005 008617 B3 7/2006
EP 0 687 853 B1 12/1995
(Continued)

OTHER PUBLICATIONS

International Search Report issued in corresponding International Patent Application PCT/EP2020/063960 dated Feb. 12, 2021.
(Continued)

*Primary Examiner* — Vivek K Shirsat
(74) *Attorney, Agent, or Firm* — Francis J. Maguire; WARE FRESSOLA MAGUIRE & BARBER LLP

(57) ABSTRACT

The invention relates to a method of hydrogen gas combustion in an industrial furnace, wherein the hydrogen fuel gas composition is introduced into the cavity from the multi nozzle burner by a central flow of gas from at least one central gas nozzle with a simultaneous input of at least one independent further flow of the additional gas composition from at least one concentric gas nozzle, the central flow of gas of the hydrogen fuel gas composition is surrounded by a concentric flow of gas of a primary additional gas composition, the central flow of gas momentum per second of the hydrogen fuel gas composition at the exit of the central gas nozzle is in the range 0.001-1.2 [kgH2 m/s$^2$] the concentric flow of gas momentum per second of the primary additional gas composition at the exit of the concentric gas
(Continued)

nozzle is in the range 0.01-10.4 [kgO2 m/s$^2$] a ratio of a heating burner power (WCHEM [W]) to a hydrogen fuel gas composition kinetic power (WKIN [W]) is in the range WRATIO=100.000-4.000.000 [1].

24 Claims, 8 Drawing Sheets

(51) Int. Cl.
*F23D 14/58* (2006.01)
*F23N 1/02* (2006.01)

(58) Field of Classification Search
USPC ..... 431/181
See application file for complete search history.

(56) References Cited

U.S. PATENT DOCUMENTS

| | | | | |
|---|---|---|---|---|
| 10,041,666 | B2 * | 8/2018 | Luka | F23C 3/004 |
| 2013/0086951 | A1 | 4/2013 | Charbonneau et al. | |
| 2018/0156451 | A1 | 6/2018 | Hirata et al. | |

FOREIGN PATENT DOCUMENTS

| | | | |
|---|---|---|---|
| EP | 0 762 050 | B1 | 3/1997 |
| EP | 1 850 067 | A2 | 10/2007 |
| EP | 3 450 843 | A1 | 3/2019 |
| JP | 2018-091592 | A | 6/2018 |
| JP | 2019-039590 | A | 3/2019 |
| JP | 2019-044977 | A | 3/2019 |
| JP | 2020-46098 | A | 3/2020 |
| JP | 2020-046099 | A | 3/2020 |
| JP | 2023-167402 | A | 11/2023 |
| WO | 2007048429 | A1 | 5/2007 |
| WO | 2015007743 | A1 | 1/2015 |
| WO | 2019039608 | A1 | 2/2019 |
| WO | 2020078775 | A1 | 4/2020 |

OTHER PUBLICATIONS

English (machine) translation of Foreign Patent Document Cite No. 1, JP 2018-091592 A, 12 pages.
English (machine) translation of Foreign Patent Document Cite No. 1, JP 2020-046098 A, 8 pages.
English (machine) translation of Foreign Patent Document Cite No. 1, JP 2023-167402 a, 13 pages.
English (machine) translation of Foreign Patent Document Cite No. 1, JP 2018-091592, 11 pages.
English translation of Notification of Reasons for Refusal of Japanese Patent Application No. 2025-009891 dispatced Jul. 24, 2026, 15 pages.
Notification of Reasons for Refusal of Japanese Patent Application No. 2025-009891, original Japanese language text, dispatached Jul. 24, 2026, 12 pages.

* cited by examiner

[$W_{chem}$ = konst.]

[TBB - temperature inside the ceramic piece of the burner]

METHOD AND BURNER OF HYDROGEN COMBUSTION IN INDUSTRIAL FURNACE, ESPECIALLY IN A GLASS FURNACE OR A FURNACE FOR METAL MELTING, BY MEANS OF A MULTI NOZZLE BURNER

CROSS REFERENCE TO RELATED APPLICATIONS

This application is the U.S. National Stage of International Application Number PCT/EP2020/063960 filed on May 19, 2020, which application is hereby incorporated by reference in its entirety.

TECHNICAL FIELD

The invention relates to a method according to the preamble part of claim 1 of hydrogen gas combustion in an industrial furnace, especially in a glass furnace or a furnace for metal melting, by means of a multi nozzle burner with controllable flow of a hydrogen fuel gas composition and an additional gas composition through a cavity to the industrial furnace to form a reacting mixture of the hydrogen fuel gas composition and the additional gas composition for combustion in the industrial furnace.

Further the invention is related to a construction of a multi nozzle burner for realization of the method of hydrogen combustion in industrial furnaces; namely a multi nozzle burner for hydrogen gas combustion in an industrial furnace, especially in a glass furnace or a furnace for metal melting, the multi nozzle burner being adapted for controllable flow of a hydrogen fuel gas composition and an additional gas composition through a cavity to the industrial furnace to form a reacting mixture of the hydrogen fuel gas composition and the additional gas composition for combustion in the industrial furnace.

BACKGROUND OF THE INVENTION

Industrial production technologies such as glass melting, metal melting or ceramic materials heating require of very high operating temperatures necessary for thermal treatment of the product. Traditionally, such high temperature (600° C.-1700° C.) is achieved by the chemical reaction between the fuel and the oxidiser. Most common type of the fuel is either gas such as methane (natural gas), propane, coal gas, and or various liquid fuels such as light and or heavy oil. The fuel is typically mixed with the oxidiser, which is combustion air or oxygen gas with O2 concentration between 90-99 weight %. The combustion system consists of the burners in the superstructure of the furnace producing flame over the heated material. The working principle of the burner is simultaneous injection of the fuel and oxidiser (combustion air or oxygen) into the furnace interior. Both these gases react at the temperature of more than the ignition temperature of the fuel gas, burn and herewith add energy to the process.

In case of the natural gas and oxygen combustion the resulting flame and its temperature reaches very high values often close to 2700° C. well above the thermal resistivity of the furnace walls and burner construction material. This problem becomes significantly more complicated when the fuel gas is hydrogen. Hydrogen in combination with oxygen exhibit very fast reaction rate creating great risk of the burner and furnace wall overheating.

The problem of natural gas and oxygen combustion in the prior art like can be handled by means of an improved control of the flame as it has been outlined in WO 2007/048429. Another solution is described in EP 0 687 853 B1 and EP 0 762 050 B1.

In WO 2020/078775 A1 of the applicant a combustion gas injector for firing a regeneratively or recuperatively heated industrial furnace is described with only a gas supply pipe and a mouth, wherein the connection thereof to a longitudinal diffuser is designed with a free-jet opening angle, wherein the longitudinal diffuser has a metallic, coolable diffuser pipe forming the mouth which is intended to form an end to the mouth of the combustion gas injector, relative to the ceramic injector insert opening. It is proposed therein that the longitudinal diffuser is designed as a flat longitudinal diffuser, wherein the diffuser pipe is formed with a diffuser output flat pipe and a diffusor input flat pipe.

In the device according to U.S. Pat. No. 5,299,929 A there are two streams of oxygen guided through a flat slot above and under a central flow of the gas with target to create two zones of combustion.

In the design according to the file U.S. Pat. No. 6,190,158 B1 the burner is built with the central flow of the oxygen, which is concentrically surrounded by the gas and the gas is then also surrounded by the oxygen.

In WO 2015/007743 A1 of the applicant a method of gas combustion in industrial furnaces is described as mentioned in the introduction, especially in glass furnaces or furnaces for metal melting, by the help of a multi nozzle burner with controllable flow of nozzles of fuel gas and additional gas, where the essence of the invention is that the fuel gas is input into cavity of the burner by at least one central gas nozzle with simultaneous input of two independent flows of the additional gas in the way that the fuel gas is surrounded by concentric flow of primary additional gas which is also surrounded by concentric flow of secondary additional gas.

However, the above solutions cannot be applied, as such to a hydrogen combustion problem. It has been become apparent that in case of the hydrogen gas and oxygen combustion the problems with the resulting flame stability are to be solved in a new approach and also flame temperatures during hydrogen gas and oxygen combustion reach very high values. Thus, hydrogen combustion problems are even more pertinent as compared to combustion with use of burning natural gas.

Hydrogen combustion as such, whilst being of high strategic interest has been proposed with necessarily specific solutions to the above mentioned problems only lately and still is a matter of contemporary research and development.

In EP 3 450 843 A1 an all metal burner is described where the outer burner pipe extends to the axial direction of an inner pipe, this is the tube tips of the nozzle structure are not in the same plane in order to allow hydrogen combustion.

In JP 2019-44977 A a nozzle structure is described with a contraction mechanism to make a flow passage of a peripheral oxygen flow narrower; essentially the gas stream throttled with contraction mechanism In JP 2019-39590 A a nozzle structure is proposed, wherein the inner hydrogen gas pipe is set back, wherein a primary air pipe covers the hydrogen gas pipe and a secondary outer peripheral air pipe covers the primary air pipe—this is to suppress mixing of the hydrogen gas and air; thus hydrogen and combustion air pipes are not in one plane.

In WO 2019/039608 A1 a three pipe configuration is proposed and is described generally for a multiple pipe structure which has a projecting inner central gas pipe which is an oxygen flow pipe and the outermost peripheral hydrogen gas pipe covers all the inner oxygen pipes. It is essential that the hydrogen gas flow is not in the center but in the periphery.

US 2018/0156451 A1 describes an ignition device and in combination with the setback position of the hydrogen gas pipe against oxygen pipe.

All above solutions for the hydrogen combustion are either related to the burner designs including ignition device or require nozzle arrangements with different protrusion of the hydrogen or oxygen pipes/nozzles. Moreover, all proposed solutions are not suitable for furnaces with high operating temperature such as glass furnaces where the temperature reach typically the range of 1400° C.-1650° C.

SUMMARY OF THE INVENTION

The aim of this invention is to further address or solve at least some of the above mentioned complications. In particular a design of a new way of method of combustion and a new burner specifically adapted to the needs and margins of combustion of hydrogen; namely use of an additional gas on the basis of oxygen, and enabling accurate setting of a hydrogen combustion process. It is highly useful to thereby improve an increasing and high radiation efficiency whilst observing NOx emission also for the hydrogen combustion process. In particular flame control with predominantly preventing overheating the furnace and burner structures is a further and not to underestimated problem to be solved with the hydrogen combustion process and the hydrogen combustion burner to be proposed in this invention.

Accordingly, it is a major object of this invention to introduce a method of improved hydrogen combustion and a hydrogen combustion burner of improved design for realization of the improved hydrogen combustion method.

This problem is solved by the method according to claim 1.

The invention accordingly starts from a method as stated in the introduction, this is a method of hydrogen gas combustion in an industrial furnace, especially in a glass furnace or a furnace for metal melting, by means of a multi nozzle burner with controllable flow of a hydrogen fuel gas composition and an additional gas composition through a cavity to the industrial furnace to form a reacting mixture of the hydrogen fuel gas composition and the additional gas composition for combustion in the industrial furnace.

The invention thus starts from the consideration that using a multi nozzle burner is well suited to provide a simultaneous controllable flow of a hydrogen fuel gas composition and an additional gas composition through a cavity to the industrial furnace to form a reacting mixture of the compositions. Advantageously and especially for industrial furnaces, being operated at high temperature, the reacting mixture of hydrogen fuel gas and additional gas compositions is instantly ignited when simultaneously being input from the multi nozzle burner.

According to the invention in the method the hydrogen fuel gas composition is introduced into the cavity from the multi nozzle burner by a central flow of gas from at least one central gas nozzle with a simultaneous input of at least one independent further flow of the additional gas composition from at least one concentric gas nozzle, wherein the central flow of gas of the hydrogen fuel gas composition is surrounded by a concentric flow of gas of at least a primary additional gas composition.

Here, the invention recognized that the central flow of gas should be established from the central flow of gas of the hydrogen fuel gas composition. Here, the invention recognized that hydrogen is a comparably lightweight gas and thus should be in the center of the flame to be ignited in the center of the flame.

According to the invention, the flow of gas of the hydrogen fuel gas is provided as the central flow of gas. Thus, in contradistinction to prior art concepts, the flow of gas of the hydrogen fuel gas is not provided in the periphery. In the case of the invention, the central flow of gas of the hydrogen fuel gas composition is surrounded at least by a concentric flow of gas of the primary additional gas composition.

Whilst other concepts provide the primary additional gas composition in the central flow, these prior art concepts put priority to provide a stable inner part of the flame being established by the comparingly high weight additional gas.

However, to the advantage, the instant invention recognized that a superior solution is provided with establishing a central flow of the comparingly lightweight hydrogen fuel gas and this comparingly lightweight hydrogen fuel gas flow should be stabilized in the periphery by the flow of additional gas composition of comparingly heavier weight. Thus, in effect, the inventive concept establishes a kind of encasing to the central flow of comparingly lightweight hydrogen fuel gas by the surrounding and/or peripheral comparingly heavier weight primary additional gas composition. It has been found that this setting of a multi-nozzle-flow of gas compositions is better suited to provide a stabilized self-ignition of flame (this is without a need of ignition device) in a high temperature surrounding with also stable flame when being blown into the industrial furnace. This central flow of gas of the hydrogen fuel gas composition being surrounded by a concentric flow of gas of a primary additional gas composition has shown up to be superior as compared to prior art concepts, which propose a conceptional different arrangement of gas flows.

According to the invention it has been further understood that the hydrogen fuel gas composition is formed by a first fuel gas constituent of 80 weight % or more of hydrogen gas and 20 weight % or less of another fuel gas or gas constituent than hydrogen gas.

Thus, whereas the hydrogen fuel gas composition is to be understood to comprise 20 weight % or less of any kind of gas, like for instance other fuel gases than hydrogen gas, also nonfuel gas or any kind of other gas can be present. Other fuel gas can be provided by hydrocarbon gas or bio-gas e.g. Non-fuel gas can e.g. be vapour or any kind of other gas; the hydrogen fuel gas composition is to be understood to comprise by far in major, this is 80 weight % or more, of hydrogen gas. Thus, in essence, in a preferred non-restricting embodiment rather pure hydrogen gas is set for constituting the hydrogen fuel gas composition.

E.g. the hydrogen fuel gas composition can consist of more or less pure hydrogen gas in total; this is 99 weight % or 100 weight % of hydrogen gas except of unavoidable minor impurities. Still nevertheless also any kind of true blend of fuel gases is possible in the hydrogen fuel gas composition as far as the hydrogen gas makes 80 weight % or more of the constituents; like e.g. the hydrogen gas forms a first fuel gas constituent of at least 80 weight %, like 85, weight %, 90 weight % or 95 weight % or the like and the rest of hydrogen fuel gas composition is formed by one or more other fuel gas constituents or some other gas.

According to the invention it has been further understood, that the additional gas composition is formed by a first oxidant gas constituent, containing oxygen with an oxygen content of more than 80 weight %.

Thus, according to the concept of the invention in principle the additional gas composition can be provided as any kind of oxidant gas containing oxygen of more than 80 weight % to form a first oxidant gas constituent. Other gas or oxidant gas constituents can be present. The another oxidant gas constituent, preferably oxygen, can be present in an amount of 20 weight % or less; this is the additional gas composition can be formed in the second oxidant gas constituent as air or from air and oxygen or oxygen enriched air.

Thus, an oxygen content of the additional gas composition comprises oxygen of 80 weight % or more oxygen or another oxidant with an oxygen content such that more than 80 weight % of the additional gas composition is constituted of oxygen.

Thus, whereas the additional gas composition is formed by a first oxidant gas constituent of oxygen it is according to the invention that the oxygen content is more than 80 weight % or another oxidant with an oxygen content of more than 80 weight % such that the first oxidant gas constituent is meant to provide at least or more than 80 weight % of oxygen to the additional gas composition.

Preferably 20 weight % or less of another oxidant gas constituent than oxygen can be present, like e.g. any kind of oxygen containing mixture or gas like, air or oxygen enriched air.

The additional gas composition thus can comprise 20 weight % or less of another oxidant gas constituent than oxygen like air or another oxydizing gas but also any other gas; this means the another oxidant gas constituent than oxygen is not necessarily an oxidizing gas but can also comprise inert gas or other gas like air or constituent gases of air e.g. nitrogen, CO2, argon or the like it should be understood however, that in a particular preferred embodiment the hydrogen fuel gas composition and additional gas composition is provided from a process of electrolysis of water; this is the decomposition of water into oxygen gas and hydrogen gas due to the passage of an electric current through water. This technique can be used to make hydrogen gas, as a main component of hydrogen fuel, and breathable oxygen gas, or can mix the two into oxyhydrogen, which is also usable as fuel, though more volatile.

Thus, in simple words, in a particular preferred embodiment the hydrogen fuel gas composition is formed by hydrogen gas including unavoidable impurities and the additional gas composition is formed by oxygen gas including unavoidable impurities, in particular hydrogen gas and oxygen gas as derived from a process of electrolysis of water.

Further, according to the invention it is provided, that a1) the central flow of gas momentum per second of the hydrogen fuel gas composition at the exit of the central gas nozzle is in the range 0.001-1.2 [kgH2 $m/s^2$]

b1) the concentric flow of gas momentum per second of the primary additional gas composition at the exit of the concentric gas nozzle is in the range 0.01-10.4 [kgO2 $m/s^2$]

Here, the invention readily takes into account the lightweight characteristics of the hydrogen fuel gas composition, which results in that the flame stabilizing parameters should be defined in terms of momentum rates, this is values of momentum per second for each flow of gas. Thus, the flow of hydrogen fuel gas and the flow of additional gas is defined here by a momentum per second for each flow of gas as specified in the independent claims.

The margins of the momentum rates take into account an advantageous mid-velocity range for the respective flow of gas.

The lightweight characteristic of the hydrogen fuel gas composition is taken into account—as can be seen from the defined values of moment per second—with values of momentum rates of about one order of magnitude below the respective values of momentum rates of the additional gas composition. These features are in synergy with a central flow of gas of the hydrogen fuel gas surrounded by the concentric flow of gas of additional gas and guarantee a stable flame forming when the reacting mixture of the hydrogen fuel gas composition and the additional gas composition is ignited for combustion in the industrial furnace.

Further, with the above-mentioned features (a1) and (b1) as defined with the inventive method, a more or less mid-velocity regime of flow is defined whilst observing the significant weight differences between the fuel gas of hydrogen and additional gas of oxidant; the advantage of a mid-velocity range—this is in the range between a low-velocity regime and a high-velocity regime—is in providing a good and efficient combustion process whilst emissions are kept low.

Further, in the mid-velocity flame regime by trend a flame control and an energy transport into the industrial furnace is advantageously supported and has advantages as compared to other concepts.

Still, however, on the one hand and given the above parameters, not only optimal combustion is to be observed but on the other hand also a temperature range should be in an acceptable range of temperatures and thus, overheating of the furnace refractories, walls, burners and other structures are to be prevented.

Accordingly, the invention is further driven by the finding in that c) a ratio of a heating burner power (WCHEM [W]) to a hydrogen fuel gas composition kinetic power (WKIN [W]) is in the range WRATIO=100.000-4.000.000 [1].

Given this range of ratio of heating burner power to a hydrogen fuel gas composition kinetic power guarantees that—whilst the kinetic power becomes larger—still the heating burner power is kept sufficiently low to prevent overheating of the furnace refractory in the mid to high velocity regime of flame dynamics; more precisely, in the mid to high momentum regime of a flow of gas for control of the flame dynamics. On the other hand, in the mid to low kinetics of the hydrogen fuel gas composition due to the rather low kinetic power further the intake of heating burner power is limited again to prevent overheating of the industrial furnace refractory.

Thus, the above-mentioned ratio of heating burner power to a hydrogen fuel gas composition kinetic power balances out an optimal weight between intake of chemical energy per kinetic power of the gas compositions and on the one hand is to provide optimal combustion. But on the other hand the ratio is set the margins right below and beyond the mid velocity range to prevent overheating of the industrial furnace refractory.

Accordingly, in a similar way the object with regard to the hydrogen combustion burner is achieved by the invention with a multi nozzle burner as claimed in instant claim 22.

Accordingly in this aspect, the invention starts from a multi nozzle burner for hydrogen gas combustion in an industrial furnace, especially in a glass furnace or a furnace for metal melting, the multi nozzle burner being adapted for controllable flow of a hydrogen fuel gas composition and an additional gas composition through a cavity to the industrial furnace to form a reacting mixture of the hydrogen fuel gas composition and the additional gas composition for combustion in the industrial furnace.

Starting from these considerations the instant invention conceptional claims for the multi nozzle burner in that

- the hydrogen fuel gas composition is introduced into the cavity from the multi nozzle burner by a central flow of gas from at least one central gas nozzle of the multi nozzle burner with a simultaneous input of at least one independent further flow of the additional gas composition from at least one concentric gas nozzle of the multi nozzle burner, wherein
- the central flow of gas of the hydrogen fuel gas composition is surrounded by a concentric flow of gas of at least a primary additional gas composition, in particular wherein the concentric flow of the primary additional gas composition is a peripheral concentric flow of gas, wherein the multi nozzle burner is further adapted to execute the inventive method as claimed.

Preferably, the multi nozzle burner comprises an injection pipe body with a central pipe with a central opening and a peripheral concentric pipe with a peripheral opening, which injection pipe body is fixed with an outlet to a ceramic piece, the peripheral concentric pipe and the central pipe comprising the at least one central gas nozzle and the at least one concentric gas nozzle, in particular therein the central gas nozzle is surrounded by the concentric gas nozzle around a perimeter which forms the outer body of the injection pipe body and optionally the concentric gas nozzle surrounds a further concentric gas nozzle around a perimeter, which forms the outer body of the injection pipe body.

In particular, therein a tip of the central gas nozzle, the concentric gas nozzle and optionally the further concentric gas nozzle is arranged in the cavity at the same distance.

These and further developed configurations of the invention are further outlined in the dependent claims. Thereby, the mentioned advantages of the proposed concept are even more improved. For each feature of the dependent claims it is claimed independent protection independent from all other features of this disclosure.

In a particular preferred first development the hydrogen fuel gas composition is introduced into the cavity of the multi nozzle burner from the at least one central gas nozzle with a simultaneous input of only a first independent further flow of the additional gas composition; namely the above mentioned primary additional gas composition. This is, the central flow of gas of the hydrogen fuel gas composition is surrounded by a concentric flow of gas of the primary additional gas composition. Respectively, in this preferred first development, a two nozzle burner with a central gas nozzle for providing the hydrogen fuel gas composition and a single concentric gas nozzle for providing the additional gas composition in a concentric flow has been found already particularly sufficient and useful to realize the inventive concept. This development of the inventive concept is based on a two-nozzle burner with one single central gas nozzle and one single concentric gas nozzle In a further developed second development, a first and second concentric gas nozzle around a central gas nozzle can be provided in a multi nozzle burner to form a three nozzle burner. This is based on an even more advantageous, however, more sophisticated structure of a three nozzle burner.

According to this second development the three nozzle burner can be operated in a preferred first conception and an even more preferred second conception as outlined below.

The first conception operation of the second development of the three nozzle burner provides a second flow of gas of hydrogen fuel gas and a concentric flow of primary additional gas and further a concentric flow of secondary additional gas; the latter being provided through a first concentric gas nozzle and second concentric gas nozzle whilst the central gas nozzle is for providing the central flow of hydrogen fuel gas composition.

In a particular preferred second development according to a first conception preferably the hydrogen fuel gas composition is introduced into the cavity of the multi nozzle burner from the at least one central gas nozzle with a simultaneous input of at least a first and a second independent further flow of the additional gas composition, wherein the

- the central flow of gas of the hydrogen fuel gas composition is surrounded by the concentric flow of gas of the primary additional gas composition, and
- the concentric flow of gas of the primary additional gas composition is surrounding a concentric flow of a secondary additional gas composition, which is in between the central flow of gas of the hydrogen fuel gas composition and the concentric flow of gas of the primary additional gas composition.

Preferably it is provided in the second development according to the first conception, that (b2) the concentric flow of gas momentum per second of the secondary additional gas composition at the exit of the concentric gas nozzle is in the range 0.01-10.4 [kgO2 $m/s^2$].

The development in the second conception is particular useful to increase an oxygen flow by increase of volume, which can be beneficial depending on the burning parameters of the fuel gas.

In the second conception of the second development, the amount of fuel gas is increased by providing a hydrogen fuel gas composition through the central gas nozzle and further a first concentric gas nozzle surrounding the central gas nozzle whilst a single concentric flow of primary additional gas composition is provided through the peripheral outer concentric gas nozzle as follows.

The following non-restrictive developments may serve to elucidate the inventive feature of in that the central flow of gas of the hydrogen fuel gas composition is surrounded at least by a concentric flow of gas of the primary additional gas composition.

Preferably, the concentric flow of the primary additional gas composition is a peripheral concentric flow of gas. Thus, in a first development as indicted above the hydrogen fuel gas composition is introduced into the cavity from a multi nozzle burner by a central flow of hydrogen gas from at least one central gas nozzle and possibly one or more further concentric flows of hydrogen gas from at least one concentric gas nozzle; thus none, one or more concentric flows of hydrogen gas from at least one concentric gas nozzle can be provided in direct contact to the central flow of hydrogen gas with a simultaneous input of at least one independent further peripheral flow of the additional gas composition from one single concentric peripheral gas nozzle.

Preferably, in a particular preferred non-restricting example of this first embodiment only a single central flow of hydrogen gas from a central gas nozzle is simultaneous input with the peripheral flow of the additional gas composition from one single concentric peripheral gas nozzle.

Preferably, in a particular preferred non-restricting example of a second embodiment as indicted above with the second conception a central flow of hydrogen gas from a central gas nozzle and a concentric flow of hydrogen gas from a concentric gas nozzle in direct contact is simultaneous input with the peripheral flow of the additional gas composition from one single concentric peripheral gas nozzle.

A peripheral flow and a peripheral nozzle is to be understood as a flow and respectively nozzle at an out circumference of the flow of gases and respectively nozzle; so to say from a peripheral pipe of an outside piece of the burner. Using this peripheral pipe of an outside piece of the burner for the primary additional gas composition according to the concept of the invention establishes said kind of encasing to the central flow of comparingly lightweight hydrogen fuel gas by the surrounding and peripheral comparingly heavier weight primary additional gas composition.

In a further non-restricting example of another embodiment as indicted above with the first conception in direct contact to the peripheral flow of comparingly heavier weight primary additional gas composition at an inward circumference a further flow of surrounding comparingly heavier weight secondary additional gas composition can be provided. Although of minor importance, still this kind of embodiment is useful and helpful, when the flow of additional gas, in particular oxygen, is to be increased in volume, in view of improving combustion process under some circumstances. This can be the case when the oxygen content of the first oxidant gas constituent should appear to be insufficient for combusting the hydrogen fuel gas composition of certain constitution.

The flow of gas momentum rates are set in a range, which takes into account the lightweight characteristic of the hydrogen fuel gas composition and the comparably larger weight of additional gas used.

In a particular preferred second development according to a second conception preferably the hydrogen fuel gas composition is introduced into the cavity of the multi nozzle burner by

- a central flow of gas of the hydrogen fuel gas composition from the at least one central gas nozzle and a concentric flow of gas of the hydrogen fuel gas composition from at least one further concentric gas nozzle, and
- with a simultaneous input of at least a one independent further flow of at least one additional gas composition from at least one concentric gas nozzle, wherein the
  - the central flow of gas of the hydrogen fuel gas composition is surrounded by the concentric flow of gas of the hydrogen fuel gas composition, and
  - the concentric flow of gas of the hydrogen fuel gas composition is surrounded by the concentric flow of the primary and/or secondary additional gas composition.

In particular therein in particular wherein the concentric flow of the primary or secondary additional gas composition is a peripheral concentric flow of gas. Thus in this preferred embodiment from center to periphery of the multi nozzle burner, in particular three or four nozzle burner the sequence of "central hydrogen fuel gas—concentric hydrogen fuel gas—concentric primary additional gas—and/or—concentric secondary additional gas" holds.

Preferably it is provided in the second development according to the second conception, that, (a2) the concentric flow of gas momentum per second of the hydrogen fuel gas composition at the exit of the concentric gas nozzle is in the range 0.001-1.2 [kgH2 m/s$^2$].

Preferably, the reacting mixture of the hydrogen fuel gas composition and the additional gas composition is conducted into the furnace through the cavity in a ceramic piece, in particular through the cavity in a furnace ceramic wall. This accomplishes an up-to-date flexible installation of the burner to the furnace.

In a particular preferred development, therein the reacting mixture of the hydrogen fuel gas composition and the additional gas composition is conducted into the furnace through the cavity and wherein a ratio between an outer circumference of the burner cross section and a circumference of the cavity cross section is in the range 0.95 to 1.0 or 1.0 to 1.05.

In other words in a first preferred variant the burner cross section is slightly smaller than the cavity cross section; this has some major benefits in that in most cases the burner can be inserted into the cavity and thus allows for a gradual adaptation of an effective cavity length; an example is shown in FIG. 3. In another second preferred variant the burner cross section is slightly bigger than the cavity cross section; this has the advantage that a particular preferred isolating and gas tight mounting of the burner to the cavity is possible.

Whilst the form of the shape of cavity can conceptional be of various kind to support flame forming, the margins of cross-section and ratio of cross-section to length of cavity are found to be crucial for optimizing a flame form whilst observing combustion efficiency and heat development in the flame.

Preferably the cavity has a cross sectional shape in form of a circle or in form of an oval or in form of a rectangular flat slot.

Preferably in a first variant the reacting mixture of the hydrogen fuel gas composition and the additional gas composition is guided with being introduced into the furnace through the cavity and a) the cavity has a cross sectional shape in form of a circle such that the cavity has the shape of a circular cylinder of axial length and circular base area, wherein a proportion between the diameter of the base area and the axial length of the circular cylinder is in the range of 2 to 6.

Preferably in a second variant the reacting mixture of the hydrogen fuel gas composition and the additional gas composition is guided with being introduced into the furnace through the cavity and b) the cavity has a cross sectional shape in form of an oval or an rectangle such that the cavity has the shape of an oval or rectangular slot of axial length and oval or rectangular base area, wherein the proportion between a longer axis of the oval or rectangular base area and the axial length of the oval or rectangular slot is in the range of 1 to 4.

These proportions as defined for the circular cylinder and the flattened slot have a beneficial flame directing effect and also put an optimum distance of the hot zone of the flame in distance to the burner body.

The rather broad regime of velocity-range of flow of gas has its preferred dynamics for combustion in a velocity regime of in between 5 to 85 m/s. In particular a low regime of velocities of flow of gas is preferred in an amount to be well below 40 m/s. This choice is among others driven to keep temperatures in an acceptable range when operating with hydrogen combustion, which as such tends to develop higher temperatures as compared to hydrocarbon fuel combustion. It has been shown that in particular low temperatures are achievable when operating in a in low velocity regime of preferably below 40 m/s.

Further, the range of velocities as described below serve to stabilize the flame as such and taking into account the lightweight characteristic of hydrogen fuel gas as mainly comprising hydrogen as compared to the additional gas of mainly comprising oxygen. Thus, the following ratio is driven basically by the significantly lower ratio of weight of the hydrogen molecule as compared to the oxygen molecule. This essential tendency and ratio as described below are to be considered in view of the above-mentioned momentum rates defined for the invention whilst being in clear difference to the usual parameters for accounting hydrocarbon combustion characteristics.

In a particular preferred development for the first development, the hydrogen fuel gas composition is introduced into the cavity at least through the central gas nozzle and at the exit of the central gas nozzle the central flow of gas of the hydrogen fuel gas composition has a velocity ranging between 5 to 85 m/s, but in particular in a preferred range of below 40 m/s.

Preferably further, in particular for this preferred development as mentioned above the primary additional gas composition is introduced into the burner in velocity-controllable capacity amount which ranges between 90 to 110 weight % necessary for stoichiometric combustion of the hydrogen fuel gas composition.

Preferably further, in particular for this preferred development as mentioned above, relative to the velocity (VO2) of the concentric flow of gas of primary additional gas composition a value of the central flow of gas of hydrogen fuel gas composition is given by the relation:

$$VH2 : vO2 = 1 : (0,3 \text{ to } 1,8).$$

Thus, in a particular preferred first embodiment the hydrogen fuel gas is introduced into the ceramic piece through the central nozzle at a velocity VH2 ranging between 5 to 85 m/s, preferably at a velocity VH2 of below 40 m/s. Further preferred is, that the primary additional gas is introduced into the burner in controllable capacity amount which ranges between 90 to 110 weight % necessary for stoichiometric combustion of the fuel gas. Further preferably the velocity VO2 of the additional gas has a value, which is given by the relation:

$$VH2 : vO2 = 1 : (0,3 \text{ to } 1,8).$$

Preferably, the additional gas has a value, which addresses the lower velocities of the hydrogen fuel gas composition as preferred.

In a particular preferred development, a flow cross section of the hydrogen fuel gas composition is given by the open area of the central gas nozzle, optionally is given by the open area of the central gas nozzle plus the open area of the further concentric gas nozzle, and the flow cross section of the additional gas composition is given by the open area of the at least one concentric gas nozzle, optionally is given by the open area of the at least one concentric gas nozzle plus the open area of the further concentric gas nozzle for a primary and a secondary additional gas composition, and/or the flow cross section of the hydrogen fuel gas composition and the flow cross section of the additional gas composition is in relation $$\phi H2 : \phi O2 = 1 : (0,3 \text{ to } 1,8).$$

In a particular preferred development of the second development the hydrogen fuel gas composition is introduced into the cavity at least through the concentric gas nozzle and at the exit of the concentric gas nozzle the concentric flow of gas of the hydrogen fuel gas composition has a velocity ranging between 5 to 85 m/s, in particular has a velocity of below m/s.

Preferably further, in particular for this preferred development as mentioned above, the secondary additional gas composition is introduced into the burner in velocity-controllable capacity amount which ranges between 90 to 110 weight % necessary for stoichiometric combustion of the hydrogen fuel gas composition.

Preferably further, in particular for this preferred development as mentioned above, relative to the velocity (vO2), of the concentric flow of gas of primary and/or secondary additional gas composition a value of the concentric flow of gas of hydrogen fuel gas composition is given by the relation:

$$VH2 : vO2 = 1 : (0,3 \text{ to } 1,8),$$

Thus, in a particular preferred second embodiment the hydrogen fuel gas is introduced into the ceramic piece through the central nozzle 1 at velocity ranging between 5 to 85 m/s, whereas at first the primary and/or secondary additional gas is introduced into the burner in controllable capacity amount which ranges between 90 to 110 weight % necessary for stoichiometric combustion of the fuel gas, in velocity, whose value is given by relation:

$$VH2 : vO2 = 1 : (0,3 \text{ to } 1,8).$$

In a particular, therein a flow cross section of the hydrogen fuel gas composition is given by the open area of the central gas nozzle as ØH2=ØArea(1M) (as e.g. shown in FIG. 1). Optionally a flow cross section of the hydrogen fuel gas composition is given by the open area of the central gas nozzle plus the open area of the further concentric gas nozzle as ØH2=ØArea(1M)+ØArea(2C) (as e.g. shown in FIG. 3).

The flow cross section of the hydrogen flow (area of central gas nozzle (FIG. 1), optionally area of the central gas nozzle plus the open area of the further concentric gas nozzle FIG. 3), to the flow cross section of the additional gas flow, in particular oxygen flow (concentric gas nozzle area of the primary and/or secondary additional gas area in the concentric peripheral gas nozzle) is in relation $$\phi H2 : \phi O2 = 1 : (0,3 \text{ to } 1,8).$$

In a particular preferred development for each multi nozzle burner at least one injector passing through a ceramic piece is provided, and by the injector an additional gas stream, preferably an additional gas stream of oxygen or an additional gas stream containing purge gas with more than 20 weight % of the oxygen, is introduced into the industrial furnace, and introducing the additional gas stream separates a water vapour rich zone of the reacting mixture's hydrogen flame and melting material inside the furnace.

Further, in a preferred development the amount and the velocity of the input hydrogen fuel gas composition and an additional gas composition and additional gas stream are controlled, in particular continuingly controlled.

It shall be understood, that the subject matter of claim 1 and the other independent claims have similar and/or identical preferred embodiments, in particular, as further defined in the dependent claims.

It shall be understood, that a preferred embodiment of the present invention can also be any combination of the dependent claims or above embodiments with the respective independent claim.

These and other aspects of the invention will be apparent from and elucidated with reference to the embodiments described hereinafter. The embodiments of the invention are described in the following on the basis of the drawings in comparison with the state of the art, which is also partly illustrated. The latter is not necessarily intended to represent the embodiments to scale. Drawings are, where useful for explanation, shown in schematized and/or slightly distorted form. With regard to additions to the lessons immediately recognizable from the drawings, reference is made to the relevant state of the art. It should be borne in mind that numerous modifications and changes can be made to the form and detail of an embodiment without deviating from the general idea of the invention. The features of the invention disclosed in the description, in the drawings and in the claims may be essential for the further development of the invention, either individually or in any combination.

In addition, all combinations of at least two of the features disclosed in the description, drawings and/or claims fall within the scope of the invention. The general idea of the invention is not limited to the exact form or detail of the preferred embodiment shown and described below or to an object which would be limited in comparison to the object claimed in the claims. For specified design ranges, values within the specified limits are also disclosed as limit values and thus arbitrarily applicable and claimable.

BRIEF DESCRIPTION OF THE DRAWINGS

Further advantages, features and details of the invention result from the following description of the preferred embodiments as illustrated in the following summary of the drawings.

DETAILED DESCRIPTION

The drawings are meant to illustrate and introduce the invention and the subsequently described examples of particular designs and do not in any case limit the scope of the protection mentioned in definition by the claims, but only clarify the essence of the invention.

Figure 10:
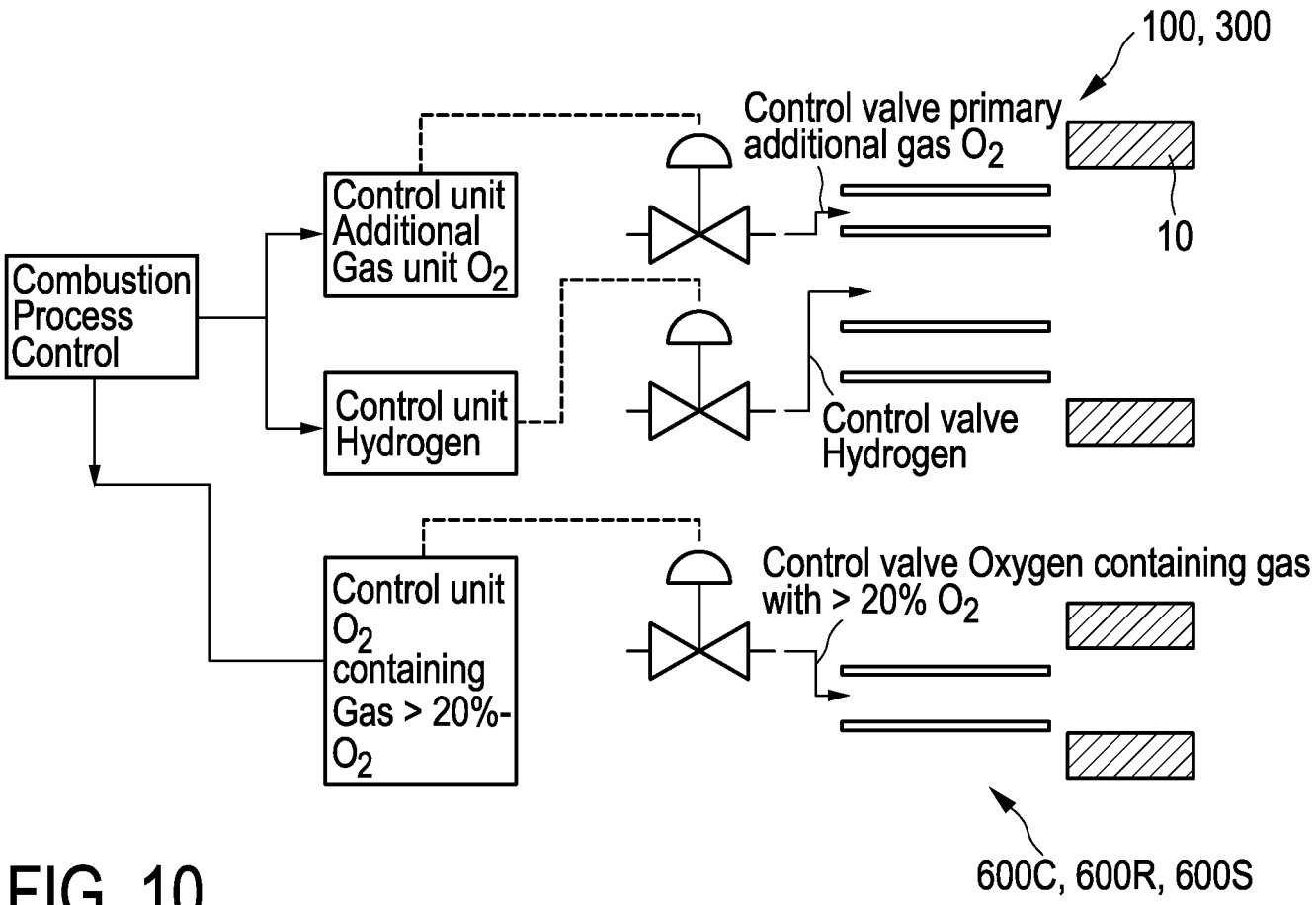
FIG. 10: a control scheme of the hydrogen, oxygen and oxygen containing gas having more than 20 weight % O2 content including use of the control valves for a two nozzle hydrogen-oxygen burner.
Figure 11:
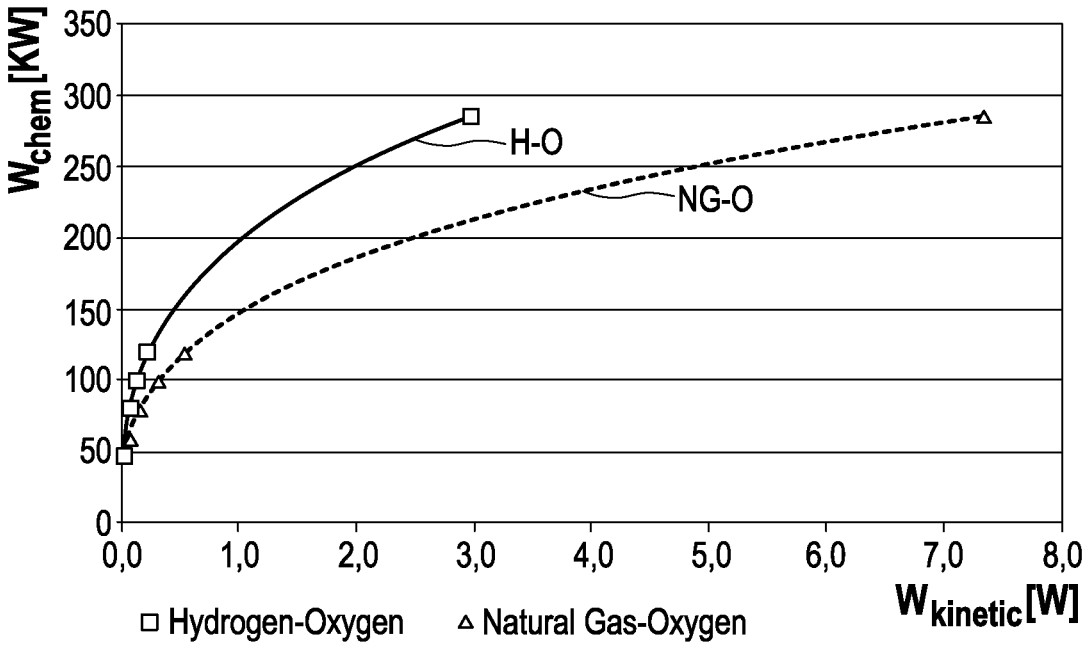
FIG. 11: a graph showing a ratio between heating burner power and WCHEM and fuel gas kinetic power WKIN at the nozzles exits.
Figure 12:
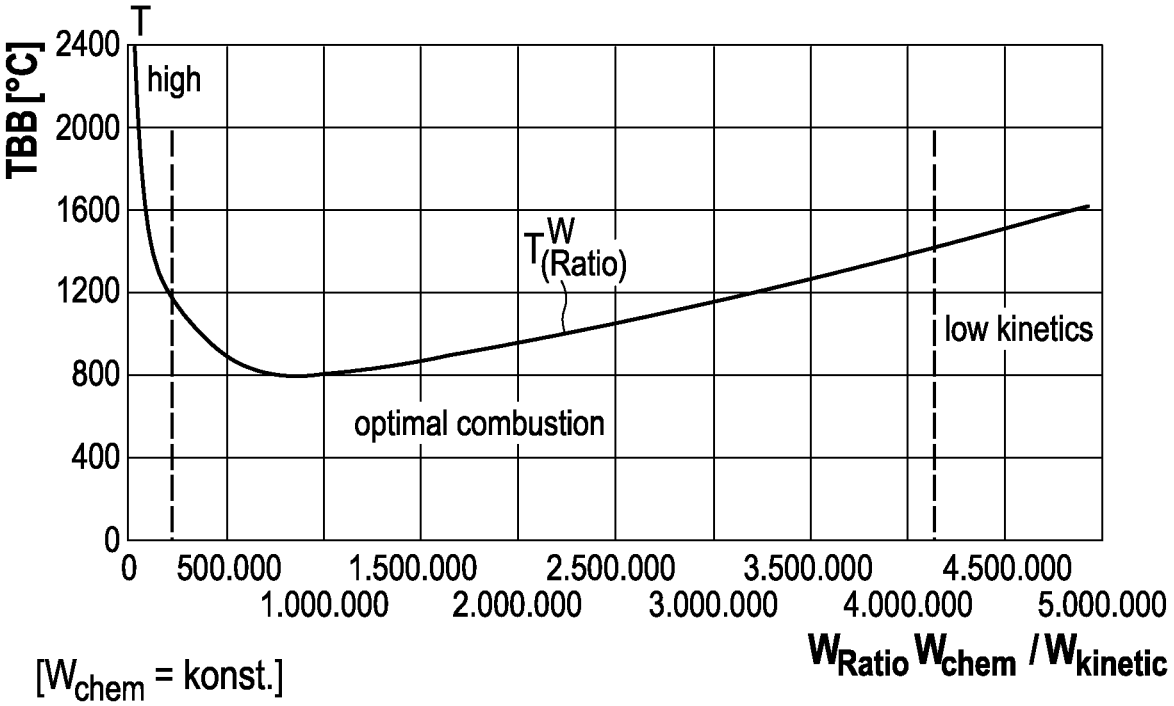
FIG. 12: a graph showing a temperature development at the burner ceramic piece in relation with WRATIO at the nozzles exits.
Figure 13:
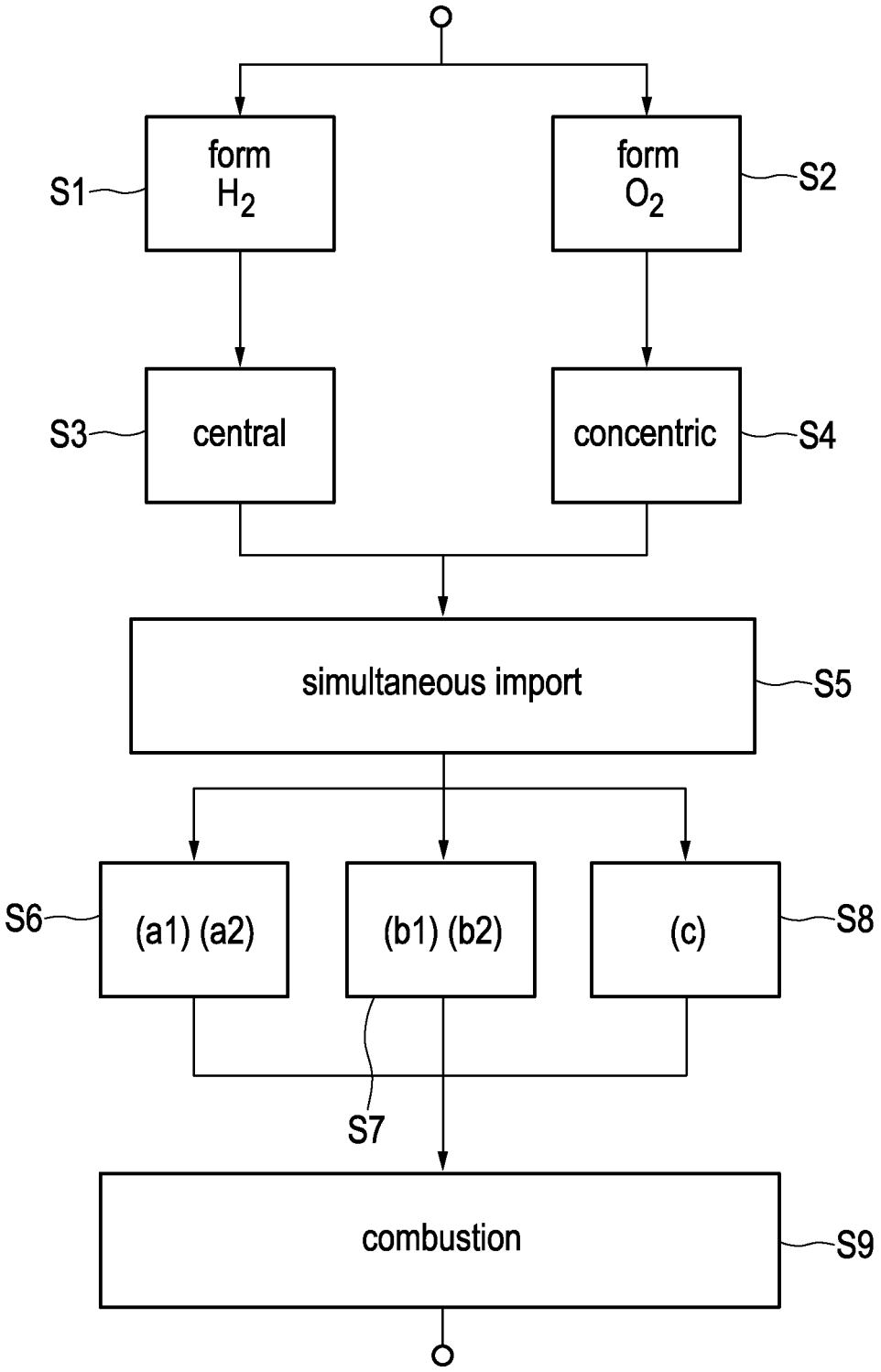
FIG. 13 a flow chart of a preferred embodiment of a method of hydrogen gas combustion in industrial furnaces, namely in glass furnaces or furnaces for metal melting, by the help of a preferred multi nozzle-burner as described above.

In the drawings the physical technical background and essential features of the invention are described with regard to FIG. 11 and FIG. 12 which are referred to throughout the detailed description and which are common to all embodiments of multi nozzle burner illustrated herein. The flow chart of the essentials of the method of operation of the concept to the invention is shown in FIG. 13, whilst embodiments of a method of control are shown in FIG. 9 and FIG. 10, which are also common to all embodiments of mutli nozzle burners illustrated herein.

As a basis of this principle indicated above at first various embodiments of multi nozzle burners for hydrogen gas combustion in an industrial furnace are described at follows with regard to FIG. 1 to FIG. 8.

Figure 9:
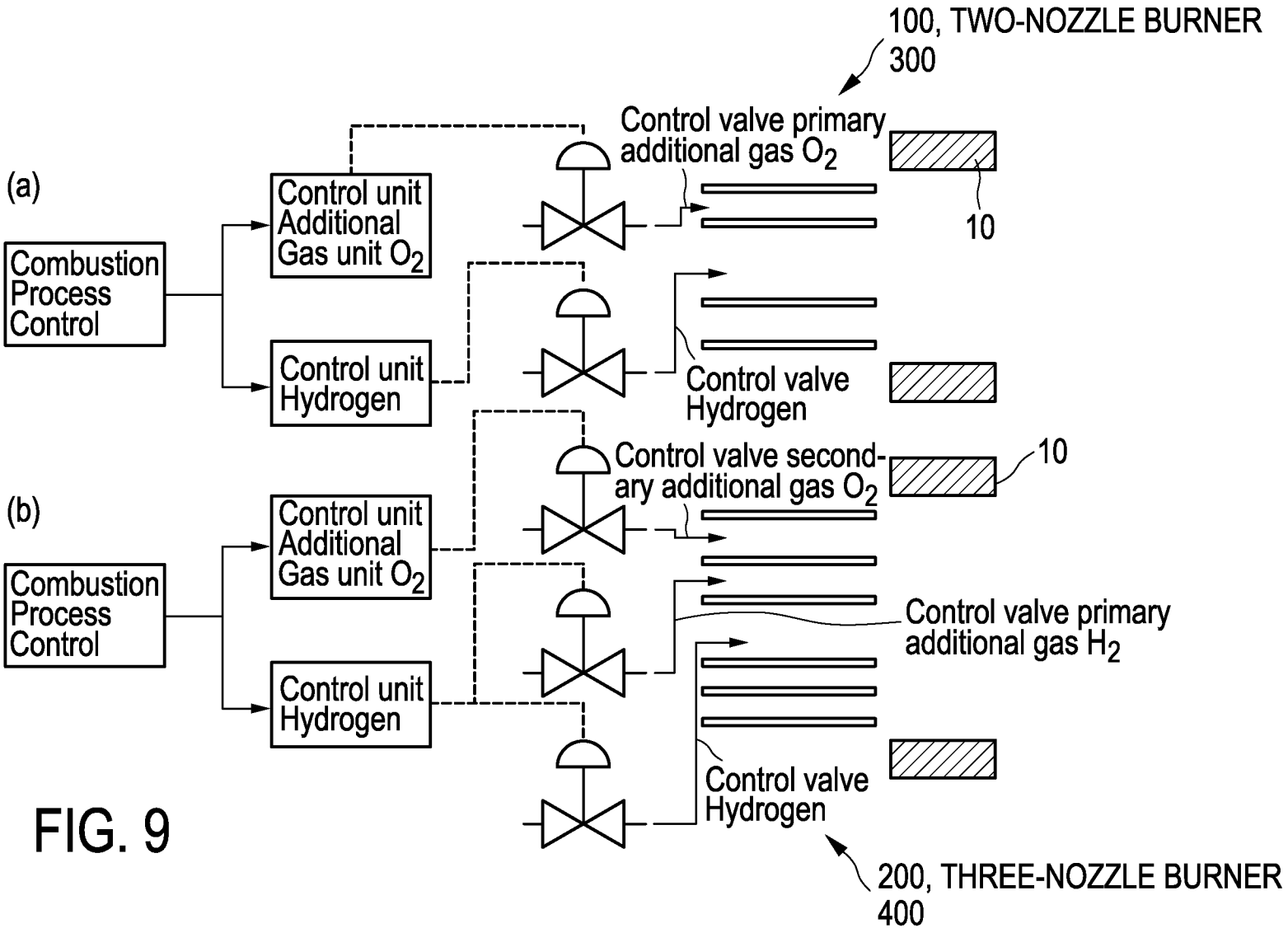
FIG. 9: a control scheme for feeding hydrogen and oxygen to a burner including use of control valves for a two nozzle burner design, namely a two nozzle hydrogen-oxygen burner as shown in view (a), and a three nozzle hydrogen-oxygen burner namely a three nozzle hydrogen-hydrogen-oxygen burner as shown in view as shown in view (b)

Essentially for a method of operation the industrial furnace a multi nozzle burner 100, 200, 300, 400 of hydrogen gas combustion in an industrial furnace 1000 is provided, especially in a glass furnace or a furnace for metal melting, by means of a multi nozzle burner 100, 200, 300, 400 with controllable flow of a hydrogen fuel gas composition and an additional gas composition as will be illustrated in an example in FIG. 9 and FIG. 10.

At first herein below it is referred to FIG. 1, FIG. 2 and FIG. 3, FIG. 4 in common—for identical or equivalent items or items of identical or equivalent function in the following the same reference marks are used. For corresponding features thus it is referred to the above description. In the following, where useful, in particular the differences between the embodiments of different FIG.'s are described further below with specific reference to the FIG. 1, FIG. 2 and FIG. 3, FIG. 4.

The flow of gas is injected through a cavity 11 having an opening 12 to the industrial furnace to form a reacting mixture of the hydrogen fuel gas composition H and the additional gas composition O for combustion in the industrial furnace 1000. The cavity 11 in the embodiments described herewith is in refractory 10 e.g. made from a ceramic block or some other refractory material to build the furnace wall.

The set goal is reached by the inventive concept, which is the way of hydrogen gas combustion in industrial furnaces 1000, especially glass furnaces or furnaces for metal melting, by the help of multi nozzle burner with controllable regulation of the flow of hydrogen gas H as well as of additional gas O.

It should be mentioned that the symbols used here do not notate a chemical structure of the gas unless indicated otherwise. The chemical structure is not in the focus of this application which can be of various kind of course. Commonly herewith it will be to assumed that the hydrogen as gas H consists of "H2"-molecules and the oxygen gas O consists of "O2"-molecules.

According to the concept of the invention

- the hydrogen fuel gas composition is formed by a first fuel gas constituent of 80 weight % or more of hydrogen gas and 20 weight % or less of another fuel gas or gas constituent than hydrogen gas, and
- the additional gas composition is formed by a first oxidant gas constituent preferably containing oxygen or air, in particular with an oxygen content of more than 80 weight %.

In this embodiment the hydrogen fuel gas composition H is formed by a first fuel gas constituent of 80 weight % or more of hydrogen gas "H2" and 20 weight % or less of another fuel gas constituent than hydrogen gas "H2".

The additional gas composition O is formed by a first oxidant gas constituent of oxygen or air with an oxygen content of more than 80 weight % or another oxidant with an oxygen content of more than 80 weight % and 20 weight % or less of another oxidant gas constituent than oxygen or air. More broadly here the term hydrogen gas H means in particular any gas containing 80 weight % or more of hydrogen "H2".

In this particular preferred embodiment, the hydrogen fuel gas composition is formed by more or less pure hydrogen gas including unavoidable impurities and the additional gas composition is formed by more or less pure oxygen gas including unavoidable impurities, in particular hydrogen gas and oxygen gas as derived from a process of electrolysis of water. In most cases this constitutes a fuel gas composition with hydrogen gas of more than 95 weight %, in particular more than 99 weight %, of hydrogen gas and an additional gas composition with oxygen gas of more than 95 weight %, in particular more than 99 weight % of oxygen gas. As shown in a first and second embodiment of FIG. 1 and FIG. 2 the hydrogen fuel gas composition H is introduced into the cavity 11 from the multi nozzle burner 100, 200. Furthermore, the reacting gas mixture of hydrogen fuel gas composition H and additional gas composition O is injected from the tip T of the burner nozzle into to the cavity 11 and therefrom to the space of the furnace through opening 12 with high internal temperature (for example 1400° C.-1650° C.). The tip T can be flush with the refractory block 10 as seen in FIG. 1 or FIG. 2 and also can be inserted therein as can be seen in FIG. 3 e.g.

Figure 1:
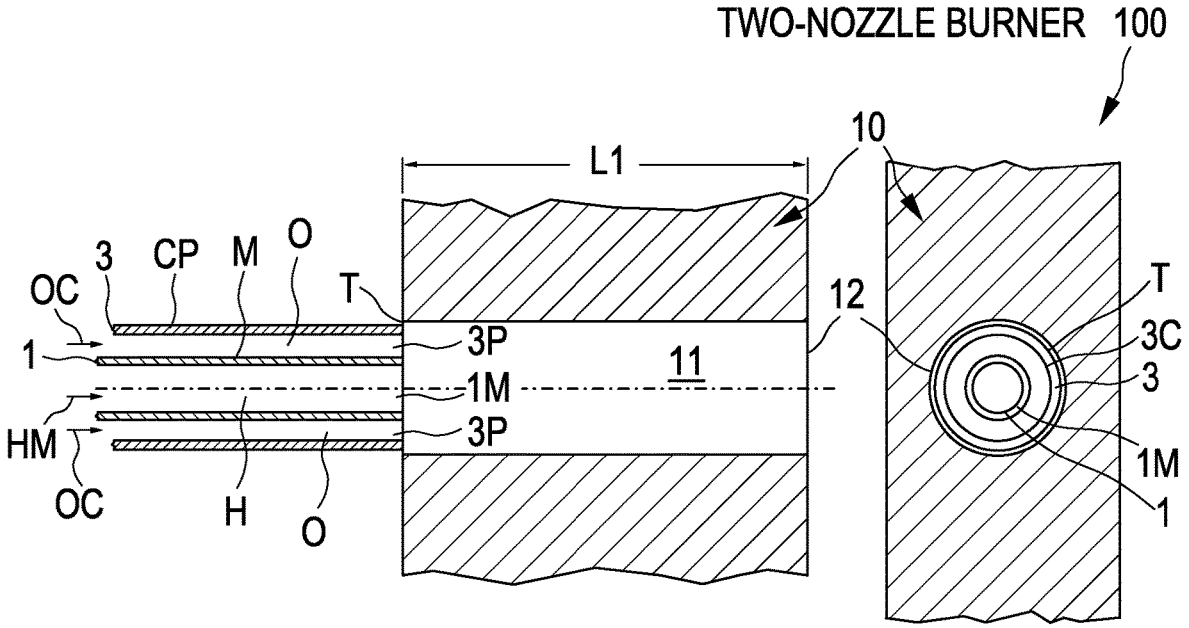
FIG. 1 a lengthwise schematic cut of a hydrogen burner scheme with a two nozzles design and the ceramic piece according to a first preferred embodiment, wherein in a first variant the nozzles are cylindrical or at least roundish.
Figure 2:
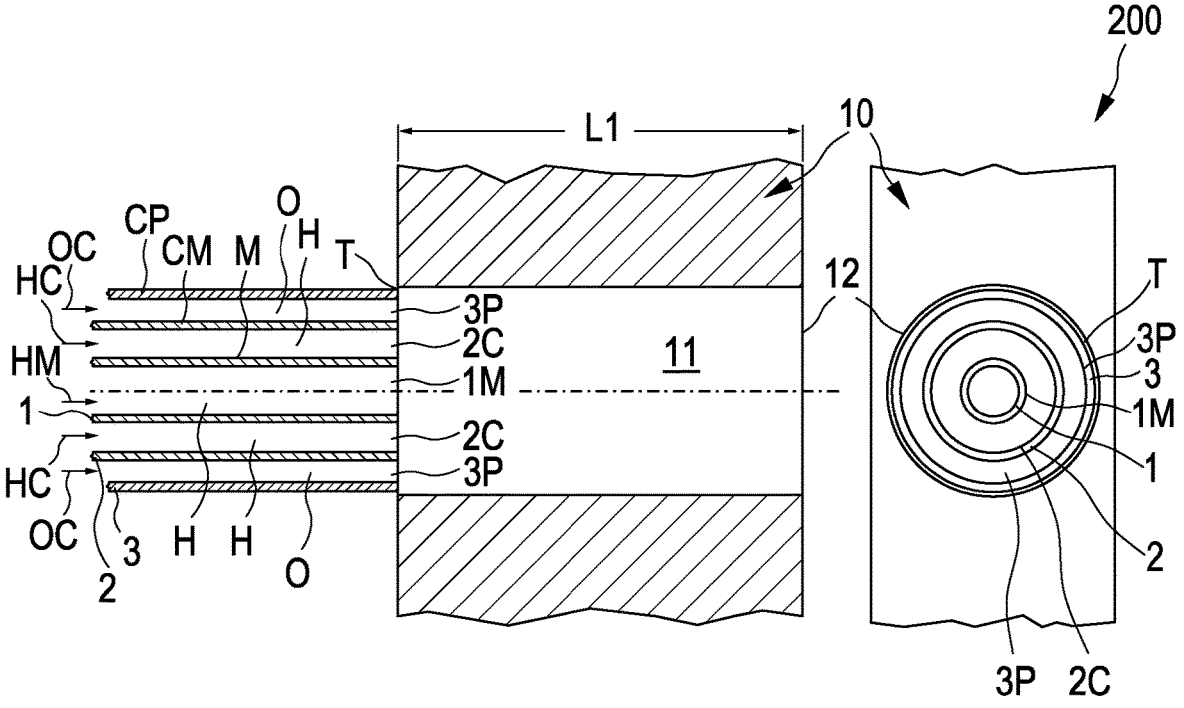
FIG. 2 a lengthwise schematic cut of an alternative design of a hydrogen burner scheme with a three nozzles design and the ceramic piece according to a second preferred embodiment, wherein in a first variant the nozzles are cylindrical or at least roundish.
Figure 3:
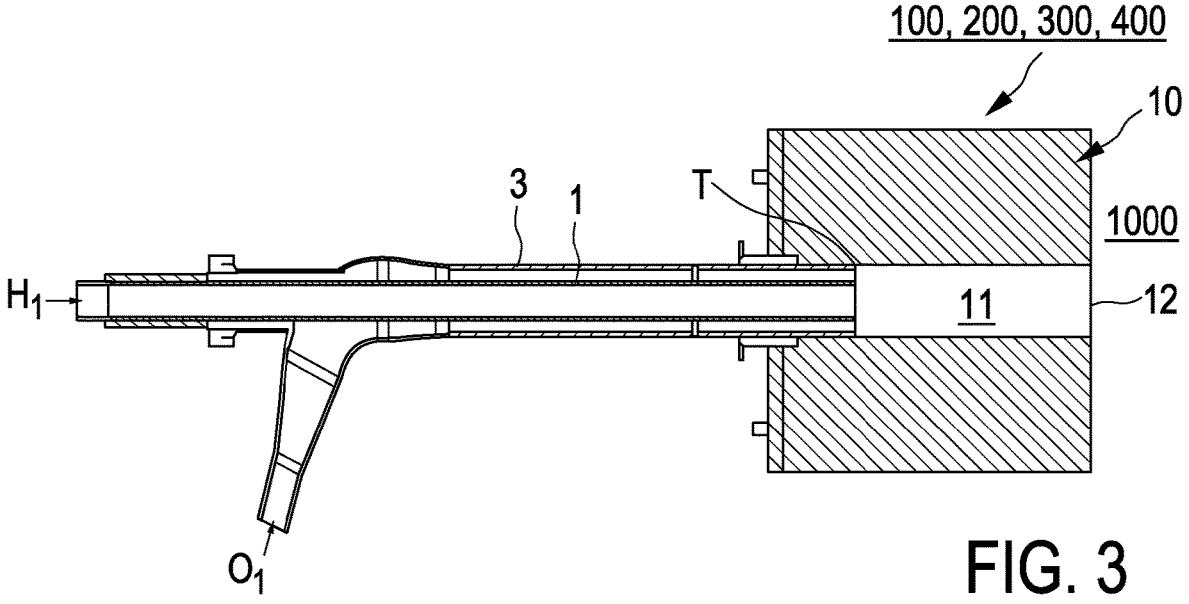
FIG. 3 a cross-sectional drawing of a preferred embodiment of a burner according to the first embodiment, which however in principle also relates to the second embodiment of the invention.

In all embodiments the central flow of gas HM is from one central gas nozzle 1 with a simultaneous input of at least one independent further flow of the additional gas composition OC from one concentric gas nozzle 3, wherein in both embodiments of FIG. 1 and FIG. 2 the concentric gas nozzle 3 is a peripheral gas nozzle.

The central flow of gas of the hydrogen fuel gas composition H thus in both embodiments of FIG. 1 and FIG. 2 is surrounded by a concentric flow of gas of an additional gas composition O.

Thus, the essence of the multi nozzle burner here is that the hydrogen gas or gas composition H is input into cavity 11 of the burner 100, 200 through at least one central gas nozzle 1 with simultaneous input of one independent flow of the additional gas O or additional gas composition O in the way that the hydrogen fuel gas H is surrounded by concentric flow of additional gas O through the concentric gas nozzle 3 as a peripheral gas nozzle.

The respective central gas nozzle's 1 central pipe M full shape central opening 1M opens the central gas nozzle 1 for the central flow of gas HM to the cavity 11. The respective concentric gas nozzle's 3 concentric peripheral pipe CP ring shape peripheral opening 3P opens the concentric gas nozzle 3 for the concentric flow of gas OC to the cavity 11. A peripheral flow and a peripheral nozzle is to be understood as a flow and respectively nozzle at an out circumference of the flow of gases and respectively nozzle; so to say from a peripheral pipe CP of an outside piece of the burner. Using this peripheral pipe CP of an outside piece of the burner for the primary additional gas composition according to the concept of the invention establishes said kind of encasing to the central flow of comparingly lightweight hydrogen fuel gas by the surrounding and peripheral comparingly heavier weight primary additional gas composition. Thus the space in central pipe M is used for the hydrogen fuel gas composition H formed by a first fuel gas constituent at least of 80 weight % or more of hydrogen gas and 20 weight % or less of another fuel gas or gas constituent than hydrogen gas. The space in concentric peripheral pipe CP is used for the additional gas composition, which is formed by a first oxidant gas constituent; in this embodiment of oxygen with an oxygen content of more than 80 weight % or another oxidant with an oxygen content of more than 80 weight % and 20 weight % or less of another oxidant gas constituent than oxygen like air or another gas.

More particularly the embodiment in FIG. 1 shows a hydrogen burner 100 with two nozzles 1, 3 and the ceramic piece 10. In this particular preferred first development the hydrogen fuel gas composition is introduced into the cavity 11 of the multi nozzle burner 100 from the at least one central gas nozzle 1 with a simultaneous input of only a first independent further flow of the additional gas composition OC; namely a primary additional gas composition OC. This is, the central flow of gas HM of the hydrogen fuel gas composition H is surrounded by a concentric flow of gas OC of the primary additional gas composition O—herewith referred to as O1 to be more precise; further even outer additional gas composition O2 can be provided with further nozzles.

Alternatively, as more particularly shown with the embodiment in FIG. 2 the hydrogen burner 200 can be designed with another concentric nozzle 2 placed in between the central nozzle 1 and burner outside piece, which is to provide a peripheral flow and a peripheral nozzle is to be understood as a flow and respectively nozzle at an outer circumference of the flow of gases and respectively nozzle; so to say from a peripheral pipe CP of an outside piece of the burner; thus, the concentric gas nozzle 3 as a peripheral gas nozzle as shown in FIG. 2. This establishes a hydrogen burner's 200 scheme with three nozzles and the ceramic piece to establish the refractory block 10. The respective another concentric gas nozzle's 2 concentric pipe CM has a ring shape mid opening 2C and opens the another concentric gas nozzle's 2 for the further concentric flow of gas to the cavity 11. The respective concentric gas nozzle's 3 concentric peripheral pipe CP ring shape peripheral opening 3P again opens the concentric gas nozzle 3 for the concentric flow of gas OC to the cavity 11.

Thus, FIG. 2 shows a hydrogen burner 200 with three nozzles 1, 2, 3 and the ceramic piece 10. In this particular preferred second development the hydrogen fuel gas composition H is introduced into the cavity 11 of the multi nozzle burner 200 from the at least one central gas nozzle 1 with a simultaneous input of only a first independent further flow of the additional gas composition OC; namely a primary additional gas composition OC. This is, the central flow of gas HM of the hydrogen fuel gas composition H is surrounded by a concentric flow of gas OC of the primary additional gas composition O—herewith referred to as O1 to be more precise; further additional gas composition O2 can be provided with further nozzles.

In this embodiment hydrogen gas H central flow HM from the central nozzle 1 is surrounded by two concentric flows of gas; at first H or O further entering combustion process from the ring shape mid opening 2C and primary additional gas O1 entering combustion process from the peripheral opening 3P, respectively. The peripheral opening 3P for the primary additional gas is used for oxygen and or gas with at least 80 weight % oxygen content.

In a first conception (not shown here) of this embodiment the opening 1M—this is the full shape central opening 1M—is used for hydrogen gas or hydrogen gas composition H, at least containing at least 80 weight % of hydrogen and the opening 2C—this is the ring shape mid opening 2C—is used for oxygen and or gas with at least 80 weight % oxygen content Thus, in an embodiment according to a first conception preferably the hydrogen fuel gas composition is introduced into the cavity of the multi nozzle burner from the at least one central gas nozzle with a simultaneous input of at least a first and a second independent further flow of the additional gas composition, wherein the

- the central flow of gas of the hydrogen fuel gas composition H is surrounded by the concentric flow of gas of the primary additional gas composition O1, which is peripheral and
- the concentric flow of gas of the primary additional gas composition is surrounding a concentric flow of a secondary additional gas composition, which is in between the central flow of gas of the hydrogen fuel gas composition and the concentric flow of gas of the primary additional gas composition.

Preferably it is provided in the second embodiment according to the first conception, that b2) the concentric flow of gas momentum per second of the secondary additional gas composition at the exit of the concentric gas nozzle is in the range 0.01-10.4 [kgO2 m/s$^2$].

In a second conception (shown in FIG. 2) of this embodiment the openings 1M, 2C—this is the full shape central opening 1M and the ring shape mid opening 2C—are used for hydrogen gas or hydrogen gas composition H, at least containing at least 80 weight % of hydrogen.

Thus, for FIG. 2 in a particular preferred second development according to a second conception preferably the hydrogen fuel gas composition is introduced into the cavity of the multi nozzle burner by

- a central flow of gas of the hydrogen fuel gas composition from the at least one central gas nozzle and a concentric flow of gas of the hydrogen fuel gas composition from at least one further concentric gas nozzle, and
- with a simultaneous input of at least a one independent further flow of at least one additional gas composition from at least one concentric gas nozzle, wherein the
  - the central flow of gas of the hydrogen fuel gas composition is surrounded by the concentric flow of gas of the hydrogen fuel gas composition, and
  - the concentric flow of gas of the hydrogen fuel gas composition is surrounded by the concentric flow of the primary and/or secondary additional gas composition.

Preferably it is provided in the second development according to the second conception, that, a2) the concentric flow of gas momentum per second of the hydrogen fuel gas composition at the exit of the concentric gas nozzle is in the range 0.001-1.2 [kgH2 m/s$^2$].

Figure 5:
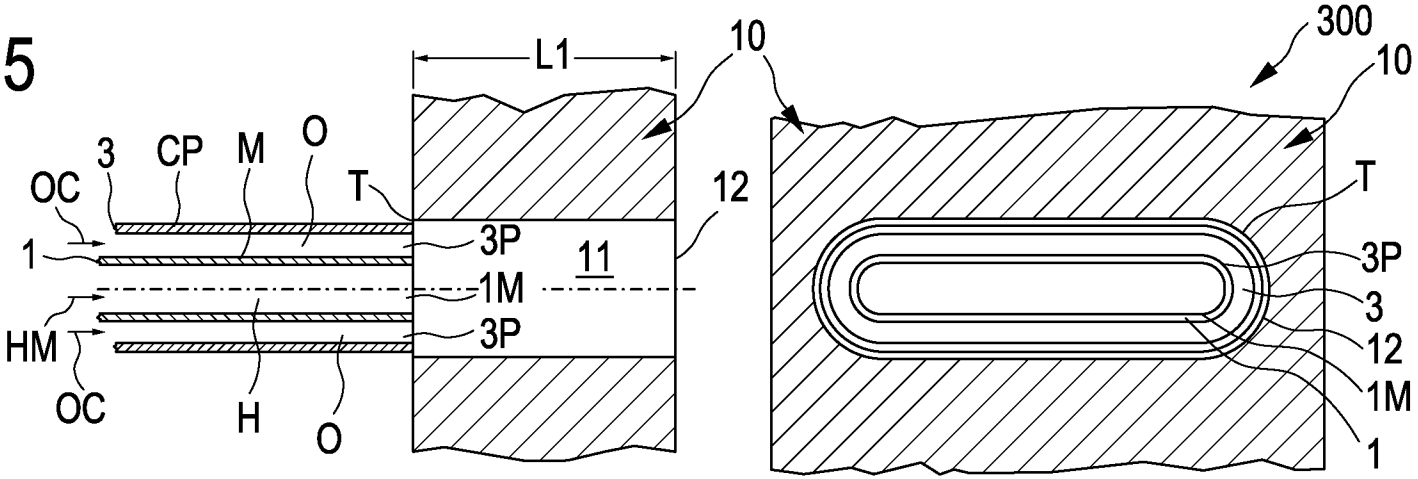
FIG. 5, FIG. 6 a lengthwise schematic cut of a hydrogen burner scheme with a two nozzles design and the ceramic piece according to a second variant of the first preferred embodiment and a second variant of the second preferred embodiment, wherein in the second variant the nozzles are flat or at least oval.
Figure 6:
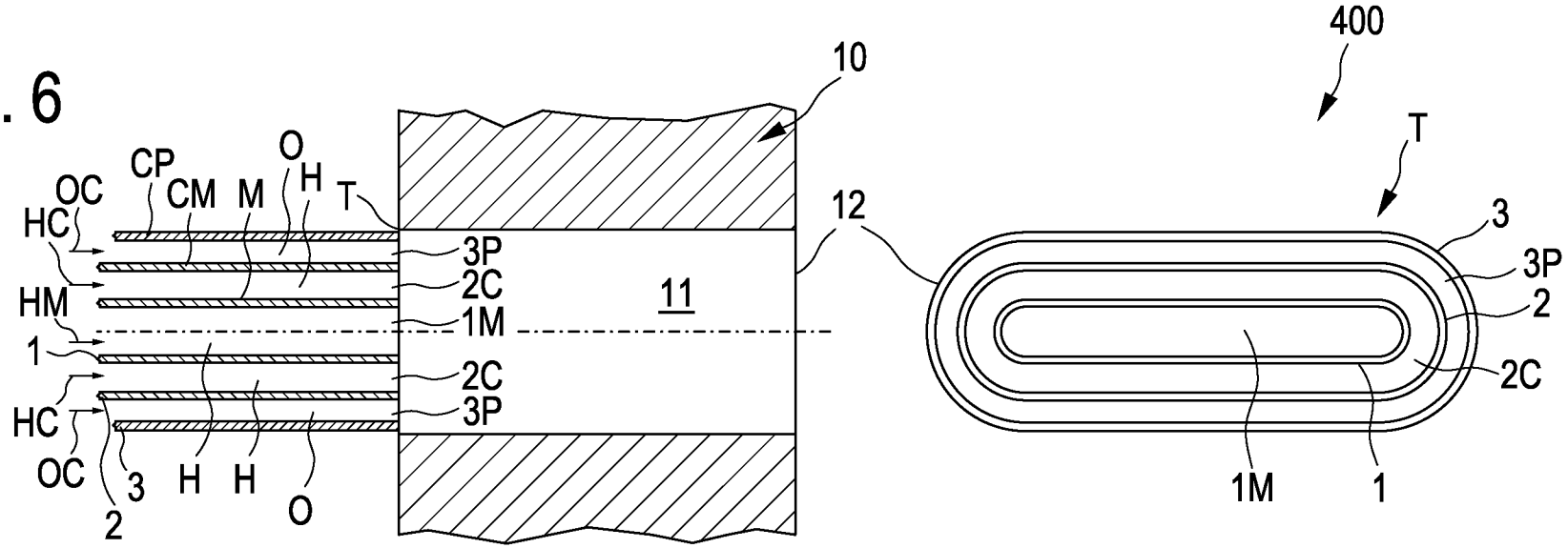

FIG. 3 shows a cross-sectional drawing of a preferred embodiment of a multi nozzle burner 100, 200 according to the first and second embodiment, which in principle also relates to the third and fourth embodiment of the invention as is described with FIG. 5 and FIG. 6.

It can be seen that preferably the reacting mixture of the hydrogen fuel gas composition and the additional gas composition O is conducted into the furnace through the cavity in a ceramic piece 10, in particular through the cavity 11 in a furnace ceramic wall. This accomplishes an up-to-date flexible installation of the burner to the furnace. In a particular preferred development therein the reacting mixture of the hydrogen fuel gas composition H and the additional gas composition O is conducted into the furnace 1000 through the cavity 11 and wherein a ratio between an outer circumference of the burner cross section and a circumference of the cavity cross section is in the range 0.95 to 1.05.

FIG. 3 shows a burner 100, 200, 200, 400 for gas combustion in industrial furnaces 1000 consisting of an injection pipe body 501 and a shaped piece 510, which is fixed on an outlet of the injection pipe body 501. The shaped piece 510 comprises said cavity 11 and the injection pipe body 501 comprises an inner gas nozzle 1, 2, 3 as described above for input of a hydrogen fuel gas H wherein a central gas nozzle 1 for the central flow of gas HM to the cavity 11 optionally is surrounded by a first and/or second concentric gas nozzle 2, 3 for input of a further hydrogen fuel gas H2 and/or a secondary additional gas O2 as described with FIG. 2 and FIG. 6. However, as described above with FIG. 1, in each case, the hydrogen fuel gas composition is introduced into the cavity 11 from the multi nozzle burner by a central flow of gas HM from the at least one central gas nozzle 1 with a simultaneous input of at least one independent further flow of the additional gas composition O from the at least one concentric gas nozzle 3, wherein the central flow of gas HM of the hydrogen fuel gas composition H is surrounded by a concentric flow of gas OC of the primary additional gas composition, in particular wherein the concentric flow of the primary additional gas composition OC is the peripheral concentric flow of gas. This is the central gas nozzle 1 in each case is around the perimeter surrounded by the concentric gas nozzle 3 for input of an additional gas O and which forms the outer body of the injection pipe body r 501. Therein the tip T of the nozzles is arranged in or at the very begin of the cavity 11. Here all nozzles and openings 1M, 2C, 3P are flush in the same one plane.

Figure 4:
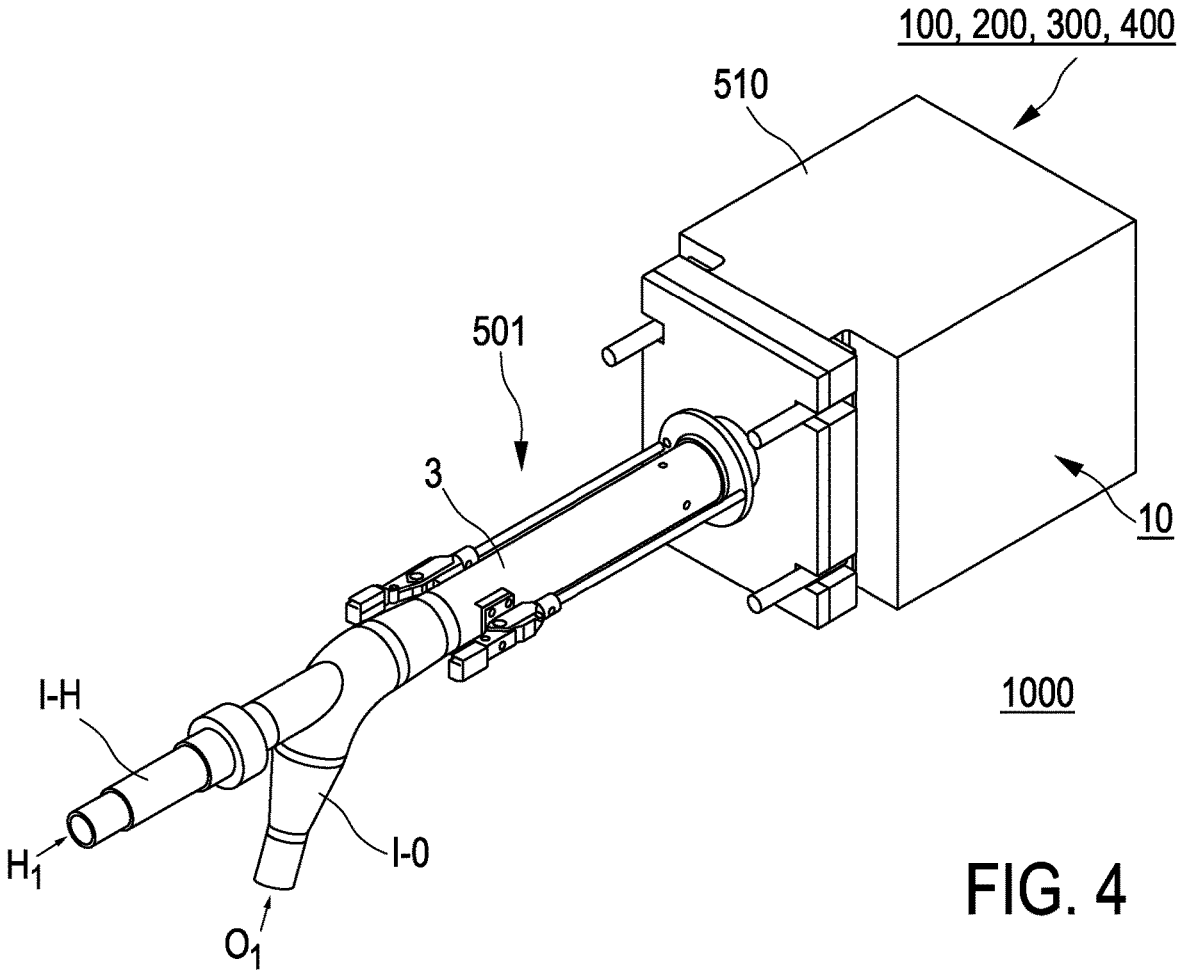
FIG. 4 a three-dimensional drawing of the preferred embodiment of FIG. 3.

FIG. 4—in a three-dimensional drawing of the preferred embodiment of FIG. 3—shows the burner 500 of FIG. 3, wherein the injection pipe body 501 is fixed with a fixing device to the shaped piece 510.

FIG. 5 shows with same reference signs a lengthwise schematic cut of a hydrogen burner scheme with two nozzles design like in the embodiment of FIG. 1 and the ceramic piece according to a second variant of the first preferred embodiment wherein in the second variant the nozzles are flat and at least oval; the respective description of FIG. 1 and FIG. 3, and FIG. 4 also applies to FIG. 5. It has been shown that are flat and at least oval nozzles have advantages. This has been described in detail in WO 2020/078775 A1 which disclosure thereof is incorporated by reference herein.

FIG. 6 shows with same reference signs a lengthwise schematic cut of a hydrogen burner scheme with three nozzles design like in the embodiment of FIG. 2 and the ceramic piece according to a second variant of the second preferred embodiment wherein in the second variant the nozzles are flat and at least oval; the respective description of FIG. 2 and FIG. 3 and FIG. 4 also applies to FIG. 6. It has been shown that are flat and at least oval nozzles have advantages. This has been described in detail in WO 2020/078775 A1 which disclosure thereof is incorporated by reference herein.

Furthermore, as reacting gas mixture has to be injected from the tip of the burner into to the space of the furnace with high internal temperature (for example 1400° C.-1650° C.) it is essential that such reacting gas stream passes through the ceramic piece 10 or the ceramic furnace wall having the opening 12 which can either be in the form of the round cylinder as shown in FIG. 7A and FIG. 10*r* in the form of an oval slot as shown in FIG. 7B and FIG. 2 or in the form of a flat rectangular slot as shown in FIG. 7C. In this way the combined heat from the furnace interior radiation and the heat created by the hydrogen-oxygen combustion is separated from the burner parts.

With regard to Tab. I it has been further approved that there are specific burner operation and burner geometry parameters, as being referred to as main parameters, which have to be observed and maintained in certain margins to achieve flame stability and to avoid overheating of the burner structure and related furnace materials.

Such main parameters are at most but not only related with a mixing rate of on the one hand the hydrogen fuel gas composition, in particular hydrogen fuel gas, and on the other hand the additional gas composition, in particular the oxygen gas. The latter can be addressed by a value of a momentum per second of hydrogen gas flow and a momentum per second of oxygen gas flow as two important figure of merits. These main parameters optionally are also related with, the turbulence in the burner and the turbulence in the flame.

Further said main parameters at most but not only are related with a proportion between the burner heating power [kW] and a combustion process kinetics; the latter can be addressed by a value of ratio of a heating burner power (WCHEM [W]) to a hydrogen fuel gas composition kinetic power (WKIN [W]) as a further figure of merit.

An extensive parametric computer fluid dynamics calculations together with combustion chemistry and turbulence modelling has been used in order to determine such burner operational and design parameters and the related values of figure of merit.

Therefrom it has been indeed derived that from Tab. I at least the above mentioned values of figure of merit are useful to address the following physical variables, which should be taken into account to address a beneficial operation of a multi nozzle burner according to the concept of the invention; that is to address a method of improved hydrogen combustion and a hydrogen combustion burner of improved design for realization of the improved hydrogen combustion method in that flame control with predominantly preventing overheating the furnace is observed. Thus to address the above mentioned main physical variable's related figure of merits comprise at least:

- the momentum per second of hydrogen gas flow, respectively hydrogen fuel gas composition $\overrightarrow{p_{H2}}$
- the momentum per second of oxygen gas flow, respectively additional gas composition $\overrightarrow{p_{O2}}$
- a ratio of a heating burner power (WCHEM [W]) to a hydrogen fuel gas composition kinetic power (WVKIN [WV]).

TABLE I shows in detail respective physical variables significant for hydrogen-oxygen burner design and operation.

| | | |
|---|---|---|
| $\overrightarrow{p_{H2}}$ | Momentum per second of hydrogen gas flow | [kgH2 m/s$^2$] |
| $\overrightarrow{p_{O2}}$ | Momentum per second of oxygen gas flow | [kgO2 m/s$^2$] |
| WKINH2 | Kinetic power of the hydrogen gas flow | [W] |
| EO2 | Kinetic energy of the Oxygen gas flow | [kg * m$^2$/s$^2$] [Nm] |
| cvH2 | Calorific value of Hydrogen gas | [J/m$^3$] |
| WCHEM | Heating Power of the Hydrogen fuel gas | [kW] [J/s] $W_{chem} = \dot{V}_{H2} \cdot cv_{H2}$ |
| WRATIO | Ratio between heating power input and kinetic Power of hydrogen flow | WRATIO = WCHEM/ WKINH2 [1] |

It has been further found that hydrogen-oxygen combustion is becoming optimal when the above mentioned relevant values of figure of merits for the main parameters are maintained in respective margins as being defined with:

a) Hydrogen Gas Momentum Per Second $$\overrightarrow{p_{H2}} = \dot{m}_{H2} \cdot v_{H2} \left[ \mathrm{kg} \cdot \frac{\mathrm{m}}{\mathrm{s}^2} \right]$$

This denotes e.g. a hydrogen fuel gas momentum per second at the exit, i.e. full shape central opening 1M of the central gas nozzle 1 as depicted in the first embodiment shown in FIG. 1 and FIG. 5. This also denotes e.g. a hydrogen fuel gas momentum per second at the exit, i.e. full shape central opening 1M of the central gas nozzle 1 as depicted in the second embodiment shown in FIG. 2 and FIG. 6 respectively.

Further this denotes e.g. a hydrogen fuel gas momentum per second at the exit, i.e. the ring shape mid opening 2C, of the concentric gas nozzle 2 as depicted in the second embodiment shown in FIG. 2 and FIG. 6 with regard to the second conception of operation respectively, wherein the hydrogen fuel gas composition is introduced into the cavity of the multi nozzle burner by a central flow of gas of the hydrogen fuel gas composition from the at least one central gas nozzle and a concentric flow of gas of the hydrogen fuel gas composition from at least one further concentric gas nozzle.

Therein the hydrogen gas momentum per second as a first figure of merit is preferably in the range of $$0.001 - 1.2[\mathrm{kgH2\ m/s^2}].$$

b) Oxygen Gas Momentum Per Second $$\overrightarrow{p_{02}} = \dot{m}_{02} \cdot v_{02}\left[\mathrm{kg} \cdot \frac{\mathrm{m}}{\mathrm{s}^2}\right]$$

This denotes e.g. in the first embodiment a concentric flow of gas momentum per second of the primary additional gas composition at the exit, i.e. ring shape peripheral opening 3P of the concentric gas nozzle 3 for the concentric flow of gas OC to the cavity 11 of the concentric gas nozzle as depicted in FIG. 1 and FIG. 5.

This also denotes e.g. in the second embodiment as depicted in the second embodiment shown in FIG. 2 and FIG. 6 with regard to the first conception of operation a concentric flow of gas momentum per second of the secondary additional gas composition at the exit, i.e. the ring shape mid opening 2C. Therein hydrogen fuel gas composition is introduced into the cavity of the multi nozzle burner from the at least one central gas nozzle with a simultaneous input of at least a first and a second independent further flow of the additional gas composition. Therein the central flow of gas of the hydrogen fuel gas composition H is surrounded by the concentric flow of gas of the primary additional gas composition O1, which is peripheral and the concentric flow of gas of the primary additional gas composition is surrounding a concentric flow of a secondary additional gas composition, which is in between the central flow of gas of the hydrogen fuel gas composition and the concentric flow of gas of the primary additional gas composition.

The primary and/or secondary additional gas composition O1, O2, in particular oxygen gas or gas containing more than 80 weight % of oxygen, therein has as a second figure of merit a momentum per second at the exit of the concentric gas nozzle 3 or the another concentric gas nozzle 2 in the range of $$0,01 - 10,4\,[\mathrm{kgO2\ m/s^2}]$$

c) Relation of the Heating Burner Power with Hydrogen Gas Flow Kinetic Power

The relation between heating burner power and fuel kinetic power characterises a trend to an optimal burner performance and is shown in FIG. 11. FIG. 11 shows the relation between heating burner power WCHEM on the y-Axis and the fuel gas kinetic power WKIN on the x-ais. It has been discovered that unlike the "natural gas-oxygen"-combustion the relation for "hydrogen-oxygen"-combustion takes place on a significantly different scale as can be seen from the comparison of the "natural gas-oxygen"-combustion curve NG-O and the "hydrogen-oxygen"-combustion curve H—O in FIG. 11.

Such difference of the proportion between WCHEM and WKIN can be put to value as its ratio WRATIO. This ratio WRATIO is a third figure of merit and has an impact at the flame temperature and namely at the temperature in the vicinity of the burner body and the ceramic piece 10 as depicted here before.

To show this impact a temperature trend related to the proportion between WCHEM and WKIN put to value as its ratio WRATIO is displayed on FIG. 12. FIG. 12 shows a temperature development at the burner ceramic piece in relation with the ratio WRATIO as a figure of merit; namely as a function of temperature T in dependence of the value of ratio WRATIO.

The optimal region of the combustion process is read therefrom in the area when the function of the temperature T dependence on WRATIO reaches its minimum. It is achieved when ratio of the chemical burner power WCHEM with hydrogen gas kinetic energy WKIN [W] is in the range WRATIO=100 000-4.000.000 [1]

Thus, in summary when the hydrogen fuel gas composition is introduced into the cavity from the multi nozzle burner by a central flow of gas from at least one central gas nozzle with a simultaneous input of at least one independent further flow of the additional gas composition from at least one concentric gas nozzle, therein the central flow of gas of the hydrogen fuel gas composition is surrounded by a concentric flow of gas of a primary additional gas composition, in particular wherein the concentric flow of the primary additional gas composition is a peripheral concentric flow of gas. A trend to optimized operation is guaranteed, according to the concept of the invention, when a1) the central flow of gas momentum per second of the hydrogen fuel gas composition at the exit of the central gas nozzle is in the range 0.001-1.2 [kgH2 m/s$^2$]

b1) the concentric flow of gas momentum per second of the primary additional gas composition at the exit of the concentric gas nozzle is in the range 0.01-10.4 [kgO2 m/s$^2$]

c) a ratio of a heating burner power (WCHEM [W]) to a hydrogen fuel gas composition kinetic power (WKIN [W]) is in the range WRATIO=100.000-4.000.000 [1].

In the following the above examples of carry out of the invention are further described in detail.

As has been shown also further with regard to FIG. 1 to FIG. 7 these details and general functional aspects of above key hydrogen burner parameters can be applied for several burner design concepts with specific geometries.

As shown with FIG. 4 the hydrogen-oxygen burner's 100, 200 concentric nozzles—cylindrical like in the first embodiment of the burner design as shown in FIG. 1, FIG. 2; still also the relevant characteristics also apply for the hydrogen-oxygen burner's 300, 400 flat nozzles.

The multi nozzle burner 100, 200, 300, 400 thus generally comprises in an injection pipe body 501 of a peripheral pipe CP an injection pipe of a central pipe CM and thus the burner outside piece is basically the peripheral concentric pipe CP as described above; this peripheral concentric pipe CP is fixed on an outer wall of the injector and is formed in a way that the diameter of its inner cylindrical cavity 10 basically corresponds with outer diameter of the body of the injection pipe body 501.

The injection pipe body 501 of a peripheral pipe CP is equipped on input with a main regulation valve of inlet I-H of the hydrogen fuel gas and is surrounded by concentric nozzle formed by a burner outside piece of peripheral concentric pipe CP equipped on input with a regulation valve of inlet I-O of the additional gas, which is oxygen in this example.

The hydrogen fuel gas enters combustion process through the openings 1M or 1M and 2C as described above with regard to the first and second embodiments shown in FIG. 1/FIG. 5 and FIG. 2/FIG. 6 respectively; that is from a central nozzle 1 or from a central nozzle 1 and a concentric gas nozzle 2; the latter is when a central and a concentric flow of hydrogen fuel gas composition is provided, which is surrounded by a single primary additional gas composition.

The additional gas composition, in particular the primary gas of oxygen enters combustion process through the opening 3P in both above mentioned cases; optionally in a first conception through the opening 3P and 2C between a central nozzle 1 and concentric gas nozzle 2; this is when only one single flow of hydrogen fuel gas composition is provided, which is surrounded by a secondary and a primary additional gas composition.

Reacting mixture of the hydrogen and oxygen is conducted into the furnace through the ceramic piece 10 through the cylindrical cavity 11.

It is beneficial that proportion of the burner outside piece of peripheral concentric pipe CP diameter and the diameter of the ceramic piece opening 12 is in the range 0.95-1.05 and the ratio between diameter of the burner outside of peripheral pipe CP and the length L1 of the ceramic piece 10 has a ration which is in the range of between 2.0 to 5.0.

Furthermore, the input velocity vH2 of the hydrogen into the ceramic piece of refractory 10 is in between values 5 to 85 m/s, in particular a velocity is below 40 m/s. Further therein at first the primary additional gas is oxygen and its input velocity into the ceramic piece in controllable capacity amount for stoichiometric combustion of the hydrogen fuel gas, in velocity whose value is given by relation $$VH2 : vO2 = 1 : (0,3 \text{ to } 1,8).$$

In an optimal case the amount and the velocity of the input hydrogen gas and primary additional gas are continuously controllable and as the fuel gas it is used comparingly pure hydrogen or hydrogen in mixture with other hydrocarbons and gases, i.e. having H2 content of at least 80 weight % or more, and as the additional gas it is used oxygen, air or another oxidant with oxygen content of at least 80 weight % or more.

Likewise, it is beneficial when between a flow cross section of the hydrogen fuel gas central nozzle, which is given by the area of opening of the central gas nozzle 1, and the flow cross section of the additional gas flow, which is the ring cross section of opening is in relation $$\phi H2 : \phi O2 = 1 : (0,3 \text{ to } 1,8)$$

As shown, with the hydrogen-oxygen burner design with three concentric cylindrical nozzles in the second embodiment the burner design as shown in FIG. 2 and FIG. 6 consists of similar features as described above.

Thus, the burner design described in FIG. 1 and FIG. 5 respectively, can be extended by the additional concentric nozzle as shown in FIG. 2 and FIG. 6 respectively.

The burner then comprises an injection pipe of central pipe M with said central gas nozzle 1 for the central flow of gas HM to the cavity 11, the burner outside piece of concentric peripheral pipe CP with concentric gas nozzle 3 for the concentric flow of gas OC to the cavity 11 and the additional concentric gas nozzle's 2 concentric pipe CM, which has a ring shape mid opening 2C and opens the another concentric gas nozzle's 2 for the further concentric flow of gas to the cavity 11. Thus, the additional concentric gas nozzle's 2 concentric pipe CM is placed between on the one hand the inner injection pipe of central pipe M and on the other hand the outer burner outside piece of concentric peripheral pipe CP with concentric gas nozzle 3 for the concentric flow of gas OC to the cavity 11; thus forming another duct for the additional gas. The injection pipe of central pipe M is equipped again on input with a main regulation valve of inlet I-H of the hydrogen fuel gas and it is surrounded by concentric nozzle equipped on input with regulation valve of inlet I-O for additional hydrogen fuel gas which is further surrounded by the burner outside piece equipped on input with a regulation valve on another inlet I-O of the additional gas-oxygen.

In a first conception (NOT SHOWN HERE) of this embodiment the opening 1M—this is the full shape central opening 1M—is used for hydrogen gas or hydrogen gas composition H, at least containing at least 80 weight % of hydrogen and the opening 2C—this is the ring shape mid opening 2C—is used for oxygen and or gas with at least 80 weight % oxygen content.

In a first conception of operation the hydrogen fuel gas thus enters combustion process through the opening 1M of the injection pipe, secondary additional gas enters the combustion process through opening 2C between the injection pipe of central pipe M and peripheral concentric gas nozzle 3P and primary additional gas of oxygen enters combustion process through the peripheral opening 3P between concentric nozzle 2C and burner outside piece of peripheral concentric pipe CP.

In a second conception of operation however more hydrogen fuel gas is available and thus enters combustion process through the opening 1M of an injection pipe in form of the central pipe M by central gas nozzle 1M, further hydrogen fuel gas enters combustion process through opening 2C between the injector of central pipe M and peripheral concentric nozzle 3P and through peripheral gas nozzle 3P additional gas enters the combustion process through the opening 3P between concentric nozzle 2C and burner outside piece.

Reacting mixture of the hydrogen and oxygen is conducted into the furnace through the ceramic piece 10 through the cylindrical cavity 11.

It is beneficial that proportion of the burner outside piece 2 diameter and the diameter of the ceramic piece opening 12 are in the range 0.95-1.05 and the ratio between diameter of the burner outside of peripheral tube 3P and the length L1 of the ceramic piece 10 is in the range of a ratio between 2 to 5.

Furthermore, the input velocity of the hydrogen from the central nozzle 1 or central nozzle 1 and concentric gas nozzle 2C and primary additional gas being hydrogen passing through the opening 3P at best; alternatively according to the first conception also by 2C into the ceramic piece vH2 and is in between values 5 to 85 m/s, in particular below 40 m/s, whereas the secondary additional gas is oxygen and its input velocity into the ceramic piece in controllable capacity amount for stoichiometric combustion of the fuel gas, in velocity, whose value is given by the relation $$VH2 : vO2 = 1 : (0,3 \text{ to } 1,8),$$

In an optimal case the amount and the velocity of the input hydrogen gas and secondary additional gas are continuously controllable and as the fuel gas it is used pure hydrogen or hydrogen in mixture with other hydrocarbons and gases and as the additional gas it is used oxygen, air or another oxidant with oxygen content 80 weight %.

Likewise, it is beneficial when a flow cross section of the hydrogen fuel gas central nozzle 1 and primary additional gas area cross cut, is given by the sum of the areas of openings 3P alone or by the sum of the areas of opening 1M and 2C:

$$\phi H2 = \phi \text{Area}(1M) + \phi \text{Area}(2C)$$

and the flow cross section of the secondary additional gas area 4 is in relation $$\phi H2 : \phi O2 = 1 : (0,3 \text{ to } 1,8)$$

Figure 7:
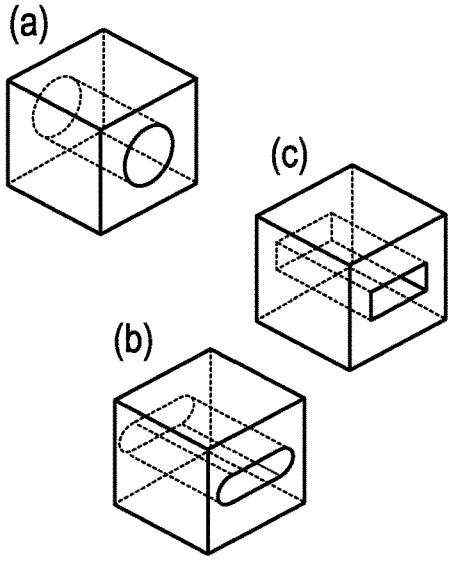
FIG. 7: three schematically depicted hydrogen burners, each with alternative nozzle cross sections, namely in view (a) with a cylindrical nozzle, in view (b) with an oval slot and in view (c) with a flat rectangular slot.
Figure 8A:
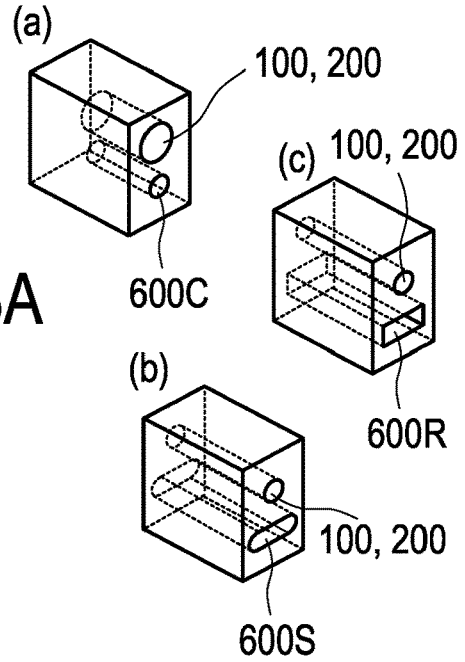
FIG. 8A: three schematically depicted examples of hydrogen burners, each with a cylindrical nozzle and positioned there beneath an additional injector for introduction of additional purge gas, as oxygen containing gas with more than 20 weight % of the oxygen, where the injector each is of different shape, namely round, rectangular and oval
Figure 8B:
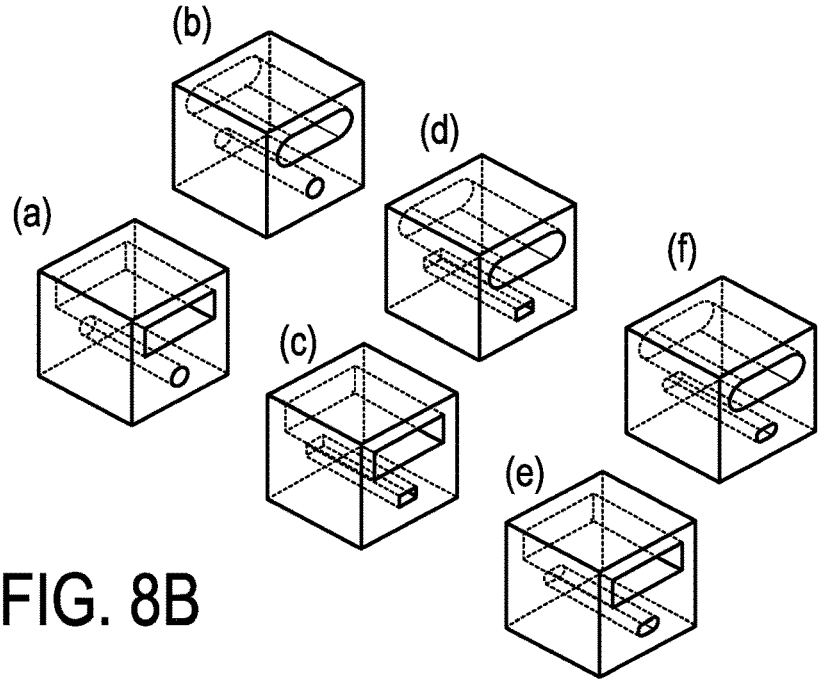
FIG. 8B: three schematically depicted examples of hydrogen burners, each with a rectangular nozzle in view (a) (c) and (e) and each with an oval nozzle in view (b) (d) and (f) and positioned there beneath an the alternative combinations of the shape and position of the additional injectors for introduction of the oxygen containing gas with more than 20 weight % of the oxygen, where the injector each is of different shape, namely round, rectangular and oval

With regard to FIG. 8A and FIG. 8B burner cross section of alternative shape are shown with a new aspect. As it has been described the hydrogen-oxygen burner can be designed with the use of the cylindrical nozzles as seen FIG. 1 and FIG. 2 and FIG. 7 (*a*), where the flame is conducted through the cylindrical cavity 11 in the ceramic piece 10 into the glass furnace or other industrial furnace.

A summary is seen as further discovered that hydrogen-oxygen burner design can be modified such as the burner nozzles and related ceramic piece openings cross section is either flat rectangular slot or oval slot as shown in FIG. 5 and FIG. 6 and FIG. 7 (*b*), (*c*). In fact FIG. 7 shows a hydrogen burner alternative nozzle cross sections with 7(*a*) cylindrical nozzle, 7(*b*) oval slot or 7(*c*) flat rectangular slot As now shown in FIG. 8A and FIG. 8B for each multi nozzle burner at least one purge-injector body 600C, 600R, 600S passing through a ceramic piece 10 is provided, and

- by the purge-injector body 600C, 600R, 600S an additional gas stream, preferably an additional gas stream of oxygen or an additional gas stream containing purge gas with more than 20 weight % of the oxygen, is introduced into the industrial furnace, and
- introducing the additional gas stream separates a water vapour rich zone of the reacting mixture's hydrogen flame and melting material inside the furnace.

The hydrogen-oxygen flame produces high concentration of the water vapour:

$$H2 + 1/2O2 \rightarrow H2O.$$

By he purge-injector body 600C, 600R, 600S introducing an additional gas stream, preferably an additional gas stream of oxygen or an additional gas stream containing purge gas with more than 20 weight % of the oxygen is introduced into the industrial furnace and a protection of the melt of glass from the effect of the water vapour is provided.

Such a high concentration of the water in the furnace atmosphere may have an adverse effect on the melting material such as glass properties and behaviour. Therefore, it is beneficial do add another purge-injector body 600C, 600R, 600S or injectors passing through the ceramic piece 5 allowing introduction of the additional gas to the combustion process. Purpose of this additional purge-injector body 600C, 600R, 600S or injectors is to add oxygen containing gas with more than 20 weight % of the oxygen in a such way that separates water vapour rich zone of the flame and melting material inside the furnace. Positioning of such additional injectors of oxygen is shown in FIG. 8A. FIG. 8A shows first examples of the shape and position of the additional injectors 600C, 600R, 600S for introduction of the oxygen containing gas with more than 20 weight % of the oxygen.

This example in FIG. 8A shows the case when the burner cross section is cylindrical while the additional purge-injector body 600C, 600R, 600S oxygen containing gas (more than 20 weight % of O2) is introduced underneath the burner having alternatively cross section shape as cylinder in (a), oval slot in (b) or flat rectangular slot (c) as shown in FIG. 8A.

As explained above the burner cross section shape can have three main types—cylindrical, oval slot or flat rectangular slot. These shapes can be freely combined with all three shapes (cylindrical, oval and flat rectangular) of an additional oxygen containing gas injector 6000, 600R, 600S as can be seen in FIG. 8B respectively below the burner 100, 200, 300, 400.

FIG. 8B shows second examples of the alternative combinations of the shape and position of the additional injectors 6000, 600R, 600S for introduction of oxygen containing gas, like air or enriched air or the like oxygen containing gas, with more than 20 weight % of oxygen.

In FIG. 9 and FIG. 10 a control for hydrogen gas, primary additional gas and secondary additional gas is described for the multi-nozzle burner 100, 200, 300, 400 applicable in either way.

A burner for hydrogen gas combustion as shown FIG. 1 and FIG. 5 in industrial furnaces, especially glass furnaces or furnaces for metal melting, comprise an injection pipe as a central pipe M and a burner outside piece of peripheral pipe CP; such kind of multi nozzle burner is fixed to an outlet of cavity and equipped with a gas input with a regulation valve of the hydrogen and primary additional gas; namely when formed as a two nozzle burner 100, 300 as shown in FIG. 1, FIG. 3 and with FIG. 9 position (a).

The burner 200, 400 according to FIG. 2, FIG. 0.6 for hydrogen gas combustion in industrial furnaces, especially glass furnaces or furnaces for metal melting, comprise an injection pipe as a central pipe M1 and a burner outside piece as a peripheral pipe CP of the burner and is equipped with inserted additional nozzle 2C between the central nozzle 1M and burner outside piece nozzle 3P. The burner is equipped on an input with a main regulation valve for input of the hydrogen fuel gas, with auxiliary valves on the input for control of the primary additional gas and the secondary additional gas through the spaces 2C and 3P respectively; namely as shown with the three nozzle burner 200, 400 and as shown with FIG. 9 position (b).

Further then it is advantageous when the regulation valve of inflow of the primary additional gas and the regulation valve of inflow of the secondary additional gas are controlled via a control unit of the additional gas connected into a block of control of combustion process. There, also via a control unit of the hydrogen fuel gas, is connected the main regulation valve of inflow of the hydrogen fuel gas with the auxiliary regulation valve, whereas the block of the control of combustion process is connected to an evaluating and control block equipped with control elements as shown with position (a) and also (b) in FIG. 9.

FIG. 9 shows a control scheme of the hydrogen gas and oxygen gas including use of the control valves for a) a two nozzle hydrogen-oxygen burner 100, 300 and b) a three-nozzle hydrogen-oxygen burner 200, 400.

The scheme is also adaptable to control the oxygen input of the burner 100, 200, 300, 400 with oxygen containing gas with more than 20 weight % of the oxygen from an additional injector 6000, 600R, 600S.

FIG. 10 on top shows a control scheme of the hydrogen, oxygen and oxygen containing gas having more than 20 weight % of O2 content including use of the control valves for two nozzle hydrogen-burner like it is the case with burner 100, 300. Still also, this scheme at the top can be extended to a three nozzle hydrogen-burner 200, 400.

The purpose of an additional injector or injectors 6000, 600R, 600S in the lower part of FIG. 10 with oxygen containing gas with more than 20 weight % of the oxygen is to control the total quantity of the oxygen containing gas. It is further beneficial to control the oxygen containing gas passing this injector by the separate valve as shown in FIG. 10 and as it has been described before in FIG. 8A, and FIG. 8B with regard to the use of purge gas. It is beneficial to control this oxygen containing gas with more than 20 weight % of O2-content either independently or according to the total oxygen quantity in the combustion process in order to maintain stoichiometric combustion and desired excess of the oxygen in the flue gases.

Further then it is advantageous when the regulation valve of inflow of the oxygen containing gas and the regulation valve of inflow of the primary or secondary additional gas are executed via a control unit of the additional gas connected into a block of control of combustion process. Therein, also via a control unit of the hydrogen fuel gas, the main regulation valve of inflow of the hydrogen fuel gas is connected with the auxiliary regulation valve. Therein the block of the control of combustion process is connected to an evaluating and control block equipped with control elements as shown in FIG. 10.

The block of the control of the combustion process is further connected to a furnace camera(s) operating at visual and infrared part of the spectra allowing for the record of the batch position and collecting spectral data from the combustion process used in the burner control.

With this presented solution it is achieved a new and higher effect in that b quite a simple construction lay out it is possible to achieve accurate setting of combustion process with high radiation efficiency and low NOx emission. Continually controllable inputs of the hydrogen fuel gas and the additional gas that enable accurate and gentle setting of shape and kinetic of the flame and enable sufficient regulation ability of the flame, influence over NOx production and prevent burner and furnace structure overheating.

The way of gas combustion for example of hydrogen gas or mixture of hydrogen with other gases including hydrocarbons, namely by the help of oxygen or air, and the burner for performance of this method is aimed for use in industrial furnaces, above all glass furnaces or furnaces for metal melting.

FIG. 1 depicts a flow chart of a preferred embodiment of a method of hydrogen gas combustion in industrial furnaces, namely in glass furnaces or furnaces for metal melting, by the help of a preferred multi nozzle-burner 100, 200, 300, 400 as described above.

Therein a method with operational method steps of operation for hydrogen gas combustion in an industrial furnace is shown, especially in a glass furnace or a furnace for metal melting, by means of a multi nozzle burner with controllable flow of a hydrogen fuel gas composition and an additional gas composition through a cavity to the industrial furnace to form a reacting mixture of the hydrogen fuel gas composition and the additional gas composition for combustion in the industrial furnace.

The method provides in a step S1 to form a hydrogen fuel gas composition, wherein the hydrogen fuel gas composition is formed by a first fuel gas constituent of 80 weight % or more of hydrogen gas and 20 weight % or less of another fuel gas constituent than hydrogen gas.

The method provides in a step S2 to form an additional gas composition, wherein the additional gas composition is formed by a first oxidant gas constituent of oxygen or air with an oxygen content of more than 80 weight % or another oxidant with an oxygen content of more than 80 weight % and 20 weight % or less of another oxidant gas constituent than oxygen or air.

According to operational step S3 the central flow of gas of the hydrogen fuel gas composition is provided and in operational step S4 surrounded by a concentric flow of gas of a primary additional gas composition.

In step S5 therein the hydrogen fuel gas composition is introduced into the cavity from the multi nozzle burner by the central flow of gas from at least one central gas nozzle with a simultaneous input of at least one independent further flow of the additional gas composition from at least one concentric gas nozzle.

Therefrom it is clear that the figure of merits according to conditions (a1) and (b1) and (c) and optionally in addition (a2) or (b2) are executed in that In step S6 according to condition (a1) the central flow of gas momentum per second of the hydrogen fuel gas composition at the exit of the central gas nozzle is in the range 0.001-1.2 [kgH2 $m/s^2$], Optionally in addition it is provided in a second development as mentioned above according to a second conception, that according to condition (a2) the concentric flow of gas momentum per second of the hydrogen fuel gas composition at the exit of a further concentric gas nozzle is in the range 0.001-1.2 [kgH2 $m/s^2$].

In step S7 according to condition (b1) the concentric flow of gas momentum per second of the primary additional gas composition at the exit of a concentric gas nozzle is in the range 0.01-10.4 [kgO2 $m/s^2$]

Optionally in addition it is provided in a second development as mentioned above according to a first conception—in alternative to the second conception—, that according to condition (b2) the concentric flow of gas momentum per second of the secondary additional gas composition at the exit of the further concentric gas nozzle is in the range 0.01-10.4 [kgO2 $m/s^2$].

In step S8 according to condition (c) a ratio of a heating burner power (WCHEM [W]) to a hydrogen fuel gas composition kinetic power (WKIN [W]) is in the range WRATIO=100.000-4.000.000 [1].

In step S9 the reacting mixture of the hydrogen fuel gas composition and the additional gas composition is combusted in the industrial furnace for glass or metal melting.

Thus, in summary the above embodiments as described can be generally outlined by the following embodiments:

1. A method of hydrogen gas combustion in industrial furnaces, especially in glass furnaces or furnaces for metal melting, by the help of a multi nozzle burner with controllable flow of nozzles of hydrogen fuel gas (hydrogen gas means any gas containing 80 weight % or more of the H2) and additional gas, wherein the hydrogen fuel gas is introduced into cavity of the burner by at least one central gas nozzle with simultaneous input of at least one independent flow of the additional gas in the way that the fuel gas is surrounded by concentric flow of primary additional gas such as:

a) Hydrogen fuel gas momentum per second at the exit the central nozzle is in the range 0.001-1.2 [kgH2 m/s$^2$]

b) The additional gas being oxygen or gas containing more than 80 weight % of oxygen having momentum per second at the exit of the concentric gas nozzle in the range 0.01-10.4 [kgO2 m/s$^2$]

c) Ratio of the heating burner power with hydrogen gas kinetic power

The ratio of the heating burner power WCHEM with hydrogen gas kinetic energy WKIN [W] is in the range WRATIO=100.000-4.000.000 [1]

2. The method of the hydrogen gas combustion in industrial furnaces according to embodiment 1, wherein the hydrogen fuel gas (hydrogen gas means any gas containing 80 weight % or more of the H2) is introduced into cavity of the burner by at least one central gas nozzle with simultaneous input of two independent flows of the additional gas in the way that the fuel gas is surrounded by concentric flow of primary additional gas which is surrounded by the concentric flow of secondary additional gas such as:

a) Hydrogen fuel gas momentum per second at the exit of the central nozzle and at the exit of the primary additional gas is in the range 0.001-1.2 [kgH2 m/s$^2$]

b) The secondary additional gas being oxygen or gas containing more than 80 weight % of oxygen having momentum per second at the exit of the secondary additional gas in the range 0.01-10.4 [kgO2 m/s$^2$]

c) ratio of the heating burner power with hydrogen gas kinetic energy the ratio of the heating burner power WCHEM with hydrogen gas kinetic energy WKIN [W] is in the range WRATIO=100.000-4.000.000 [1]

3. The method of the hydrogen gas combustion according to the embodiments 1 and 2, wherein reacting mixture of the hydrogen and oxygen is conducted into the furnace through the cavity in the ceramic piece or the furnace ceramic wall. This cavity having cross section shape of the circle, oval slot or rectangular flat slot.

4. The method of the hydrogen gas combustion according to the embodiments 1, 2, and 3 wherein reacting mixture of the hydrogen and oxygen is conducted into the furnace through the cavity having the ratio between the outer circumference of the burner and circumference of the cavity cross section in the range 0.95 to 1.05.

5. The method of the hydrogen gas combustion according to the embodiments 1, 2, 3 and 4 wherein reacting mixture of the hydrogen and oxygen is conducted into the furnace through the cavity having:

a) in case of the burner and the cavity having the shape of the cylinder, the proportion between the diameter of the burner outside piece 2 and the length of the cavity L1 is in the proportion 2 to 6.

b) in case of the burner and the cavity having the shape of either elliptical slot or rectangular flat slot, the proportion between the longer axis of the slot cross section and the length of the cavity L1 is in the proportion 1 to 4.

6. The method of the hydrogen gas combustion according to the embodiments 1, 3, 4, 5 and 6 wherein the hydrogen fuel gas is introduced into the ceramic piece through the central nozzle at velocity (VH2) ranging between 5 to 85 m/s, whereas at first the primary additional gas is introduced into the burner in controllable capacity amount which ranges between 90 to 110 weight % necessary for stoichiometric combustion of the fuel gas, in velocity (VO2), whose value is given by relation:

$$VH2 : vO2 = 1 : (0,3 \text{ to } 1,8)$$

7. The method of the hydrogen gas combustion according to the embodiment 6 wherein a flow cross section of the hydrogen fuel gas central nozzle, which is given by the area of the central nozzle and the flow cross section of the additional gas is in relation $$\phi H2 : \phi O2 = 1 : (0,3 \text{ to } 1,8)$$

8. The method of the hydrogen gas combustion according to the embodiment 1, 2, 3, 4, 5 and 6 wherein the hydrogen gas is introduced into the ceramic piece through the central nozzle and primary additional gas being hydrogen passing through the opening into the ceramic piece at velocity (vH2) between the values 5 to 85 m/s, whereas the secondary additional gas is oxygen and its input velocity into the ceramic piece in controllable capacity amount for stoichiometric combustion of the fuel gas, at velocity (vO2), whose value is given by relation $$VH2 : vO2 = 1 : (0,3 \text{ to } 1,8).$$

9. The method of the hydrogen gas combustion according to the embodiment 8 wherein a flow cross section of the hydrogen fuel gas central nozzle and primary additional gas area cross cut, is given by the sum of the areas 1M and 2C:

$$\phi H2 = \phi \text{Area}(1M) + \phi \text{Area}(2C)$$

and the flow cross section of the secondary additional gas area is in relation $$\phi H2 : \phi O2 = 1 : (0,3 \text{ to } 1,8)$$

10. The method of the hydrogen gas combustion according to the embodiments 1 through 9, wherein the burner nozzles 3, 4, 9 and the cavity in the ceramic piece 7 openings cross section have the shape of the either circle, flat rectangular slot or oval slot.

11. The method of the hydrogen gas combustion according to the embodiments 1 through 10, wherein additional injector or injectors passing through the ceramic piece allow introduction of the additional gas preferably oxygen containing gas with more than 20 weight % of the oxygen in a such way that separates water vapour rich zone of the hydrogen flame and melting material inside the furnace 12. The method of the hydrogen gas combustion according to the embodiments 1 to 11, wherein the amount and the velocity of the input fuel gas, primary additional gas, secondary additional gas and additional gas preferably oxygen containing gas with more than 20 weight % of the oxygen separating water vapour rich zone of the hydrogen flame and melting material inside the furnace are continually controllable.

13. The method of the hydrogen gas combustion according to the embodiments 1 to 12, wherein the amount and the velocity of the input fuel gas, primary additional gas, secondary additional gas and additional gas preferably oxygen containing gas with more than 20 weight % of the oxygen separating water vapour rich zone of the hydrogen flame and melting material inside the furnace are controlled and optimized based on operational data, batch imaging and multispectral camera measurements by the control system inside glass melting furnace or industrial kiln.

14. The method of the hydrogen gas combustion according to the embodiments 1 to 13, wherein as the fuel gas is pure hydrogen or hydrogen in mixture with other hydrocarbons and gases and as the additional gas it is used oxygen, air or another oxidant with oxygen content of more than 80 weight %.

The invention claimed is:

1. A method of hydrogen gas combustion in an industrial furnace, especially in a glass furnace or a furnace for metal melting, by means of a multi nozzle burner with controllable flow of a hydrogen fuel gas composition and an additional gas composition through a cavity to the industrial furnace to form a reacting mixture of the hydrogen fuel gas composition and the additional gas composition for combustion in the industrial furnace, wherein:

the hydrogen fuel gas composition is introduced into the cavity from the multi nozzle burner by a central flow of gas from a tip of at least one central gas nozzle with a simultaneous input of at least one independent further flow of the additional gas composition from a tip of at least one concentric gas nozzle, wherein the central flow of gas of the hydrogen fuel gas composition is surrounded by a concentric flow of gas of at least the additional gas composition, wherein the concentric flow of the additional gas composition is a peripheral concentric flow of gas, wherein the tip of the at least one central gas nozzle, the tip of the at least one concentric gas nozzle and optionally a tip of a further concentric gas nozzle are arranged flush to the cavity or inserted in the cavity at a same insertion distance, the hydrogen fuel gas composition is formed by a first fuel gas constituent of 80 weight % or more of hydrogen gas and 20 weight % or less of another fuel gas or gas constituent than hydrogen gas, and the additional gas composition is formed by a first oxidant gas constituent containing oxygen with an oxygen content of 80 weight % or more of oxygen gas, and a1) the central flow of gas momentum per second of the hydrogen fuel gas composition exiting the tip of the at least one central gas nozzle is in the range 0.001-1.2 [kg m/s$^2$], b1) the concentric flow of gas momentum per second of the additional gas composition exiting the tip of the at least one concentric gas nozzle is in the range 0.01-10.4 [kg m/s$^2$], c) a ratio of a heating burner power (WCHEM [W]) to a hydrogen fuel gas composition kinetic power (WKIN [W]) is in the range WRATIO=100,000-4,000,000.

2. The method according to claim 1, wherein the hydrogen fuel gas composition is introduced into the cavity of the multi nozzle burner from the at least one central gas nozzle with a simultaneous input of at least a first and a second independent further flow of the additional gas composition, wherein the the central flow of gas of the hydrogen fuel gas composition is surrounded by the concentric flow of gas of the additional gas composition, and the concentric flow of gas of the additional gas composition is surrounding a concentric flow of a secondary additional gas composition, which secondary additional gas composition is in between the central flow of gas of the hydrogen fuel gas composition and the concentric flow of gas of the additional gas composition, wherein the concentric flow of the additional gas composition is a peripheral concentric flow of gas.

3. The method according to claim 2, wherein b2) the concentric flow of gas momentum per second of the additional and/or secondary additional gas composition exiting the tip of the concentric gas nozzle is in the range 0.01-10.4 [kg m/s$^2$].

4. The method according to claim 1, wherein the hydrogen fuel gas composition is introduced into the cavity of the multi nozzle burner by the central flow of gas of the hydrogen fuel gas composition from the at least one central gas nozzle and a concentric flow of gas of the hydrogen fuel gas composition from the concentric gas nozzle, and with a simultaneous input of at least one independent further flow of at least one additional gas composition from the further concentric gas nozzle, wherein the the central flow of gas of the hydrogen fuel gas composition is surrounded by the concentric flow of gas of the hydrogen fuel gas composition, and the concentric flow of gas of the hydrogen fuel gas composition is surrounded by the concentric flow of the additional gas composition and/or a secondary additional gas composition, wherein the concentric flow of the additional gas composition or the secondary additional gas composition is a peripheral concentric flow of gas.

5. The method according to claim 4, wherein a2) the concentric flow of gas momentum per second of the further hydrogen fuel gas composition exiting the tip of the concentric gas nozzle is in the same range as the range 0.001-1.2 [kg m/s$^2$] of the central flow of gas.

6. The method according to claim 1, wherein the reacting mixture of the hydrogen fuel gas composition and the additional gas composition is conducted into the furnace through the cavity in a ceramic piece, wherein the cavity is in a furnace ceramic wall.

7. The method according to claim 1, wherein the reacting mixture of the hydrogen fuel gas composition and the additional gas composition is conducted into the furnace through the cavity and wherein a ratio between an outer circumference of the burner cross section and a circumference of the cavity cross section is in the range 0.95 to 1.05.

8. The method according to claim 1, wherein the cavity has a cross sectional shape in a form of a circle or in a form of an oval or in a form of a rectangular flat slot.

9. The method according to claim 8, wherein the reacting mixture of the hydrogen fuel gas composition and the additional gas composition is guided with being introduced into the furnace through the cavity and a) the cavity having the cross sectional shape in a form of a circle is such that the cavity has the shape of a circular cylinder of axial length and circular base area, wherein a proportion between the diameter of the base area, and the axial length of the circular cylinder is in the range of 2 to 6, or b) the cavity having the cross sectional shape in a form of an oval or a rectangle is such that the cavity has the shape of an oval or rectangular slot of axial length and oval or rectangular base area, wherein the proportion between a longer axis of the oval or rectangular base area and the axial length of the oval or rectangular slot is in the range of 1 to 4.

10. The method according to claim 1, wherein the hydrogen fuel gas composition is introduced into the cavity at least through the at least one central gas nozzle and exiting the tip of the at least one central gas nozzle the central flow of gas of the hydrogen fuel gas composition has a velocity ranging between to 85 m/s.

11. The method according to claim 1, wherein the additional gas composition is introduced into the burner in velocity-controllable capacity amount which ranges between 90 to 110 weight % necessary for stoichiometric combustion of the hydrogen fuel gas composition.

12. The method according to claim 1, wherein relative to the velocity of the concentric flow of gas of the additional gas composition a value of the central flow of gas of hydrogen fuel gas composition is given by the relation:

$$VH2 : VO2 = 1 : 0.3 \text{ to } 1 : 1.8.$$

13. The method according to claim 1, wherein a flow cross section of the hydrogen fuel gas composition is given by the open area of the at least one central gas nozzle, optionally is given by the open area of the at least one central gas nozzle plus the open area of the further concentric gas nozzle, and the flow cross section of the additional gas composition is given by the open area of the at least one concentric gas nozzle, optionally is given by the open area of the at least one concentric gas nozzle plus the open area of the further concentric gas nozzle for the additional and a secondary additional gas composition, and the flow cross section of the hydrogen fuel gas composition and the flow cross section of the additional gas composition is in relation $$\phi H2 : \phi O2 = 1 : 0.3 \text{ to } 1 : 1.8.$$

14. The method according to claim 1, wherein the hydrogen fuel gas composition is introduced into the cavity at least through the concentric gas nozzle and exiting the tip of the concentric gas nozzle the concentric flow of gas of the hydrogen fuel gas composition has a velocity ranging between 5 to 85 m/s.

15. The method according to claim 1, wherein a secondary additional gas composition is introduced into the burner in velocity-controllable capacity amount which ranges between 90 to 110 weight % necessary for stoichiometric combustion of the hydrogen fuel gas composition.

16. The method according to claim 1, wherein, relative to the velocity of the concentric flow of gas of the additional and/or a secondary additional gas composition a value of the concentric flow of gas of hydrogen fuel gas composition is given by the relation:

$$VH2 : VO2 = 1 : 0.3 \text{ to } 1 : 1.8.$$

17. The method according to claim 1, wherein a flow cross section of the hydrogen fuel gas composition is given by the open area of the at least one central gas nozzle, optionally is given by the open area of the at least one central gas nozzle plus the open area of a further concentric gas nozzle, and the flow cross section of the further concentric gas nozzle to the concentric gas nozzle area of the secondary additional gas composition is in relation $$\phi H2 : \phi O2 = 1 : 0.3 \text{ to } 1 : 1.8.$$

18. The method according to claim 1, wherein for each multi nozzle burner at least one injector passing through a ceramic piece is provided, and by the injector an additional gas stream, preferably an additional gas stream of oxygen or an additional gas stream containing purge gas with more than 20 weight % of the oxygen, is introduced into the industrial furnace, and introducing the additional gas stream separates a water vapor rich zone of a hydrogen flame of the reacting mixture and melting material inside the furnace.

19. The method according to claim 1, wherein the amount and the velocity of the input hydrogen fuel gas composition and an additional gas composition and additional gas stream are controlled continuingly.

20. The method according to claim 19, wherein the control is based on operational data, batch imaging and/or multispectral camera measurements by the control system of the glass melting furnace or industrial kiln wherein the control is configured to optimize the amount and the velocity of the input hydrogen fuel gas composition and an additional gas composition and additional gas stream.

21. The method according to claim 1, wherein the hydrogen fuel gas composition is formed from only hydrogen gas as the only fuel gas constituent, or the hydrogen fuel gas composition is formed from hydrogen gas in mixture with another fuel gas of hydrocarbons and other gases, and/or the additional gas composition is formed from only oxygen gas as the only oxidant gas constituent, or the additional gas composition is formed from air or another oxidant gas with oxygen content of 80 weight % or more.

22. A multi nozzle burner for hydrogen gas combustion in an industrial furnace, especially in a glass furnace or a furnace for metal melting, the multi nozzle burner being adapted for controllable flow of a hydrogen fuel gas composition and an additional gas composition through a cavity to the industrial furnace to form a reacting mixture of the hydrogen fuel gas composition and the additional gas composition for combustion in the industrial furnace, wherein the hydrogen fuel gas composition is introduced into the cavity from the multi nozzle burner by a central flow of gas from a tip of at least one central gas nozzle of the multi nozzle burner with a simultaneous input of at least one independent further flow of the additional gas composition from a tip of at least one concentric gas nozzle of the multi nozzle burner, wherein the central flow of gas of the hydrogen fuel gas composition is surrounded by a concentric flow of gas of at least the additional gas composition, wherein the concentric flow of the additional gas composition is a peripheral concentric flow of gas wherein the tip of the at least one central gas nozzle, the tip of the at least one concentric gas nozzle and optionally a tip of a further concentric gas nozzle are arranged flush to the cavity or inserted in the cavity at a same insertion distance, and the multi nozzle burner is further adapted to execute the method as claimed in claim 1.

23. The multi nozzle burner of claim 22, wherein the multi nozzle burner comprises an injection pipe body with a central pipe with a central opening and a peripheral concentric pipe with a peripheral opening, which injection pipe body is fixed with an outlet to a ceramic piece, the peripheral concentric pipe and the central pipe comprising the at least one central gas nozzle and the at least one concentric gas nozzle, wherein the at least one central gas nozzle is surrounded by the at least one concentric gas nozzle around a perimeter which forms the outer body of the injection pipe body and optionally the at least one concentric gas nozzle surrounds a further concentric gas nozzle around a perimeter, which forms the outer body of the injection pipe body.

24. The multi nozzle burner according to claim 22, wherein a flow cross section of the hydrogen fuel gas composition is given by the open area of the at least one central gas nozzle, optionally is given by the open area of the at least one central gas nozzle plus the open area of the further concentric gas nozzle, and the flow cross section of the additional gas composition is given by the open area of the at least one concentric gas nozzle, optionally is given by the open area of the at least one concentric gas nozzle plus the open area of the further concentric gas nozzle for the additional and a secondary additional gas composition, and the flow cross section of the hydrogen fuel gas composition and the flow cross section of the additional gas composition is in relation $$\phi H2 : \phi O2 = 1 : 0.3 \text{ to } 1 : 1.8.$$

* * * * *